United States Patent [19]

Brodeur et al.

[11] Patent Number: 4,519,037

[45] Date of Patent: May 21, 1985

[54] COMPUTER ASSISTED SYMMETRICAL ANALYSIS FOR HAIR STYLISTS

[76] Inventors: Jacques Brodeur; Mireille Brodeur, both of 1546 Armida Verde Vista, San Dimas, Calif. 91773

[21] Appl. No.: 327,195

[22] Filed: Dec. 3, 1981

Related U.S. Application Data

[63] Continuation of Ser. No. 55,012, Jul. 5, 1979, abandoned.

[51] Int. Cl.[3] ..... G06F 15/20

[52] U.S. Cl. ..... 364/400; 364/300

[58] Field of Search ... 364/200 MS File, 900 MS File, 364/300, 400; 132/9, 45 R

[56] References Cited

U.S. PATENT DOCUMENTS 3,241,562 3/1966 Gronier ..... 132/45 R 3,570,500 3/1971 Berry ..... 132/45 R

OTHER PUBLICATIONS

Brandt et al., "Summary of Several Software Packages Developed for the Human Engineering Systems Simulation (Hess) Facility", Aerospace Medical Research Laboratory, Sep. 1971, AMRL-TR-71-96.

*Primary Examiner*—Raulfe B. Zache

*Attorney, Agent, or Firm*—John E. Wagner

[57] ABSTRACT

Method and apparatus for aiding the hair stylist in ascertaining a subject's true facial characteristics and their inter-relationship. The method includes the steps of taking precise significant measurements, determining ratios of related measurements, and comparing the ratios with similar standard ratios. Deviations from standard ratios are noted and the appropriate recommendation for correcting the measured assymetry given. The apparatus includes a digital computer for making the calculations and comparisons as well as storage of standard data and recommendations.

19 Claims, 8 Drawing Figures

COMPUTER ASSISTED SYMMETRICAL ANALYSIS FOR HAIR STYLISTS

REFERENCE TO RELATED APPLICATIONS

This is a continuation of U.S. patent application, Ser. No. 055,012, filed July 5, 1979, now abandoned.

BACKGROUND OF THE INVENTION

From the first recorded history in the field of hair styling until the very present, before this invention, hair stylists' experience, training, asthetic ability and desires as well as the habits of the customer have largely provided the basis for hair styling to be accomplished on the customer. Many hair stylists have innate ability to visualize just what hair style is truly appropriate for a particular customer and they often are correct. Many stylists have difficulty in explaining the reasoning behind their selections and treatment. Customers on the other hand are often influenced by habit, a particular hair style seen on another person or in a photograph without any rational basis for assurance that such a hair style is appropriate for themselves.

The hair style selected depends upon a melding of the hair stylists' opinion and the desires of the customer. Often successful, but far too often, less then satisfactory.

Stylists often have difficulty envisioning the various styles on a particular customer and thus tend to favor those styles with which they are most familar, or personally like.

BRIEF STATEMENT OF THE INVENTION

Faced with this truly unsatisfactory basis for hair style selection, we have analyzed much of the literature guiding hair stylists, and found little in the way of guidance in obtaining a balanced relationship between the features of the customer or subject which give an esthetically pleasing appearance.

We have studied the masters of art, particularly Michelangelo and De Vinci, and have learned that they recognized the need for such balance or as we term it, symmetry, and each of these masters studied the human features and physiological makeup to a far greater degree than many people realize. The end results of both of these masters has been a truly esthetically beautiful works of art demonstrating true symmetry of features.

We have also studied the work of anthropologists to determine if their studies give aid in the field of hair styling. We have found that the anthropologists have developed a precise measuring system for skeletal structures of the human body which is termed anthropometry. These standards of measurements include precisely defined points from which the various measurements are taken. We use these same measurement points to ensure uniformity between subjects and to establish some normal or standards against which the stylist may compare his particular customer or subject.

Unfortunately hair stylists can lay little claim to the knowledge and artistic ability of Michelangelo and Leonardo de Vinci and likewise the anthropologists measurements are directed more toward evolutionary, racial or developmental studies of the human skeleton then its asthetics or beauty. We have combined the use of anthropometry as used by anthropologists and have measured dozens of females to discover variations in the skeletal structure which have significance in the appearance of the subject and consequently in the selection of appropriate hair style. By comparison of these averages and standards with the works of the masters, Michelangelo and da Vinci, we find that these masters invariably selected in their beauteous works optimum symmetrical faces. For example, in the Pieta, the face of the Madonna is truly an ideal oval and exhibits true symmetry. Unfortunately, few if any of the subjects which we measured, exhibit these ideals. Moreover, unrecognized by many hair stylists, one or more of the features of most subjects exhibit actual asymmetries, such as a nose with a slight bending to one side or another, eyes or ears of different heights. These asymmetries, coupled with slight disproportionate features in comparison with the body size, present challenges for the hair stylist, first to recognize and then to accommodate in his selection of hair style and in actual styling process.

From our analysis, we find that at least 18 and as many 23 different measurements or criteria are significant in the determination of a subject's head and facial characteristics. Additionally, the ratios of many of the measurements are most important than their absolute value. For example, a nose on a female which measures $2\frac{1}{2}''$ may appear long if she is only five feet tall. But on a female who is five feet nine inches, the same length nose is ideally proportioned.

We have established not only a number of measurements to be taken, a range of optimum values for each, and a set of ratios. We have discovered the innerplay between the measurements and the ratios as well as the observations of asymmetries to provide as many as 94,000 different combinations affecting the appearance of the head, face, and body as a whole. Such a number of combinations defies practical human analysis and useage without assistance.

We have reduced the analysis above described to a computer program and through the use of a computer are enabled to accomplish the necessary computational activity to establish ratios, to compare the subject's measurements and ratios to standards which we have established, and to provide a true analysis of the individuals, controlling and significant criteria. We have further developed a series of charts to assist the stylist in taking the physical measurements, and in using the computer produce criteria to develop an artistic presentation of one or more recommended hair styles for an individual.

The hair stylist may easily make the precise measurements employing measuring aids of this invention. Next given the analysis of the individual's features, the stylist is better able to apply his artistic ability in generating a visual presentation of recommended styles, and more importantly, the stlyist may use his artistic ability in carrying out his own styling concepts and use of his skills within the guide posts supplied. The end result, when properly applying is to produce truly the appropriate and most favorable appearance of the subject.

BRIEF DESCRIPTION OF THE DRAWING

The foregoing brief description of the invention may be more clearly understood from the following detailed description and by reference to the drawing in which.

DETAILED DESCRIPTION OF THE INVENTION

Figure 1:
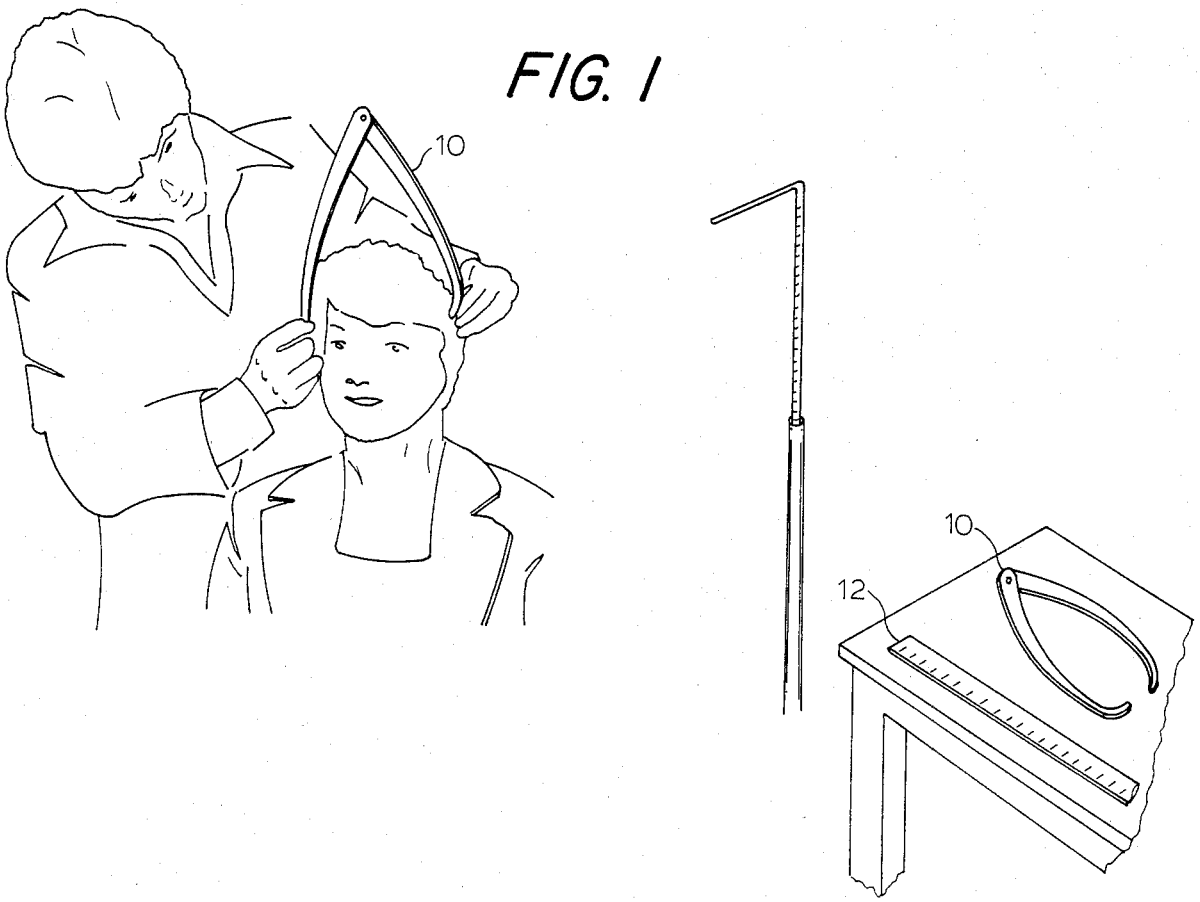
FIG. 1 is a perspective view of a hair stylist taking data for use in accordance with this invention.
Figure 2:
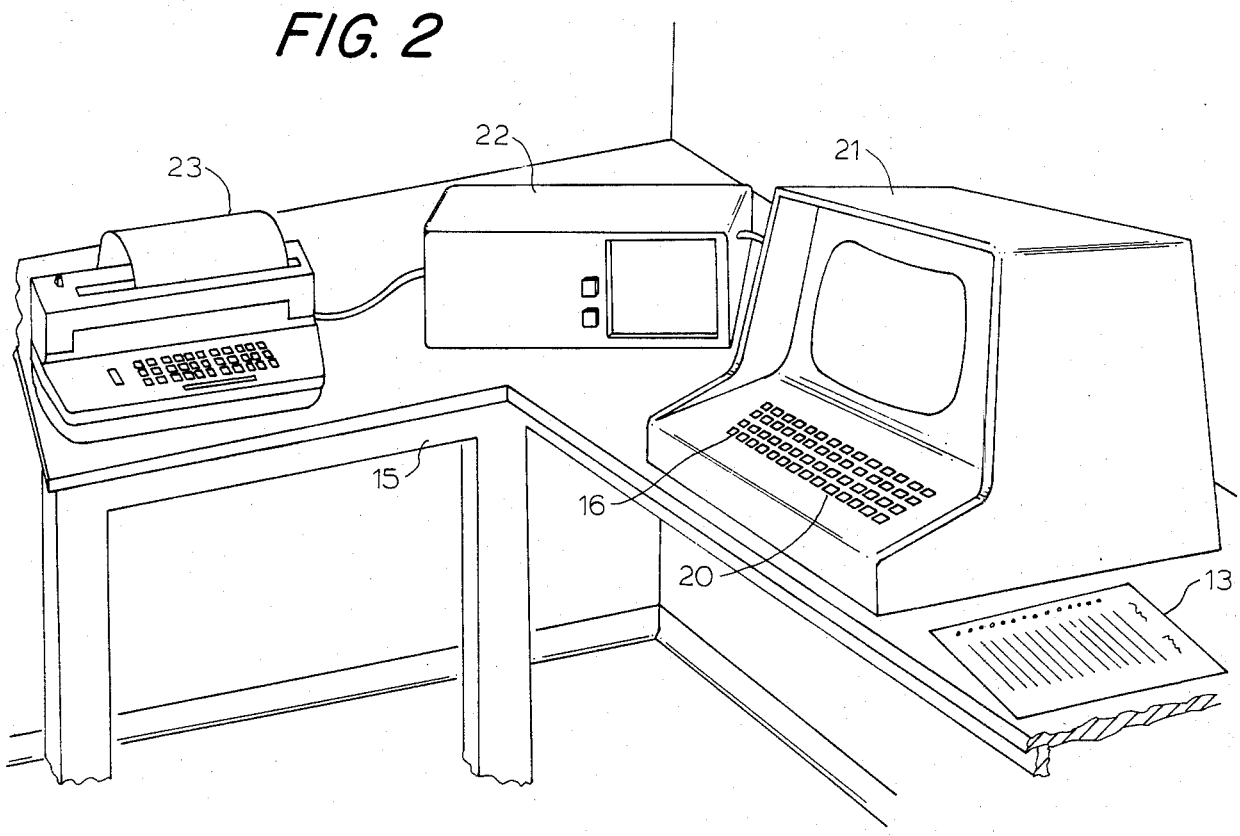
FIG. 2 is a perspective view of an appropriate computer for carrying out the computational aspects of this invention.
Figure 3:
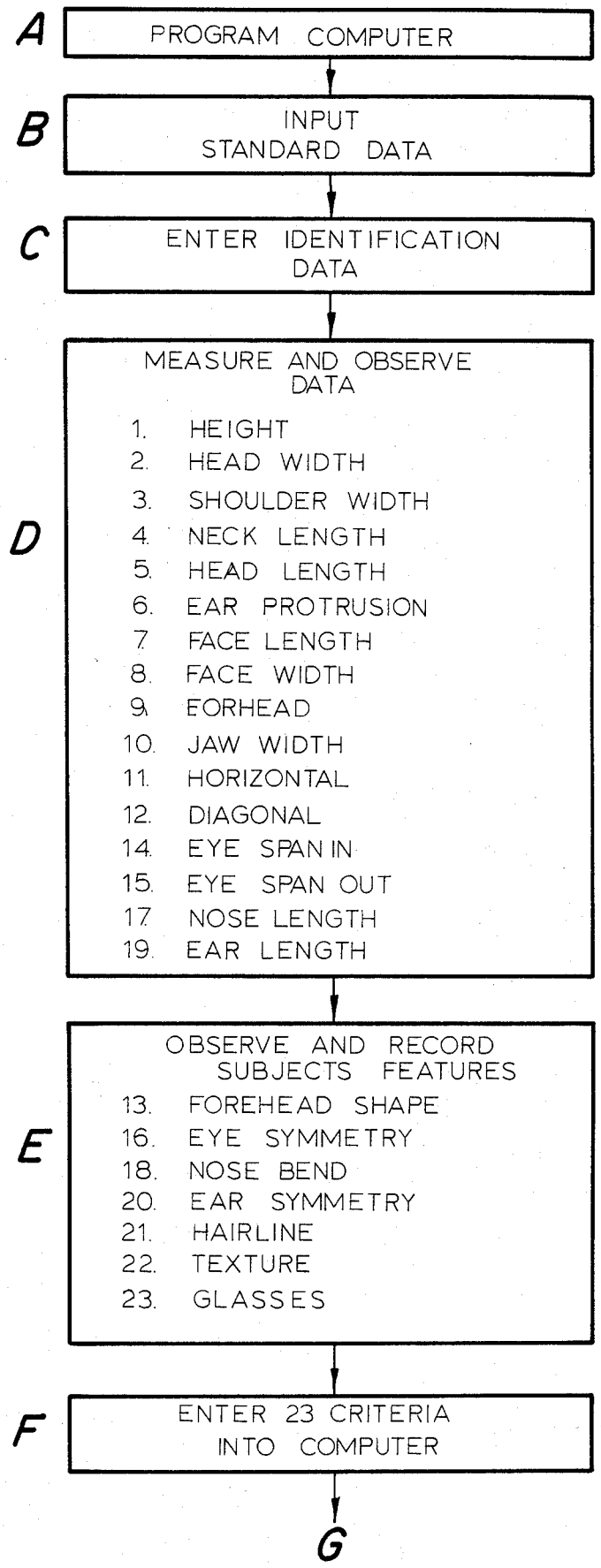
FIG. 3 is a flow chart of the generalized method of this invention.
Figure 3:
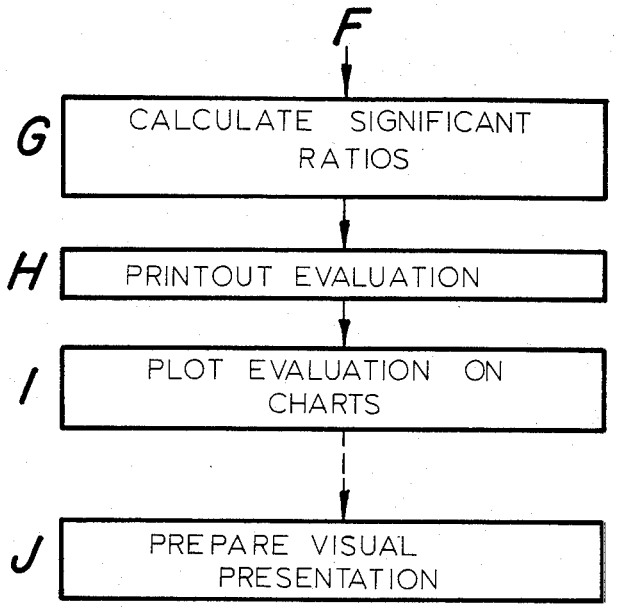

Now referring to FIGS. 1 through 3, the basic technique for establishing input data of a particular subject is illustrated therein. In FIG. 1, a hair stylist is in the process of taking an anthrometric measurement of the head width of a subject employing a pair of Calipers 10. The measurement being taken is one of sixteen individual measurements taken of the subject at the precise positions standardized by anthropologists and illustrated by the numbers appearing in FIGS. 4 and 5. The first and basic measurement is the height of the subject which is taken employing a standard clinical ruler. The following measurements are taken employing the calipers 10 at the positions noted in FIGS. 4 and 5.

| No. | Measurement |
|---|---|
| 1 | Height employing a standard clinical measuring ruler |
| 2 | Head width |
| 3 | Shoulder width |
| 4 | Neck length |
| 5 | Head length |
| 6 | Ear protrusion |
| 7 | Face length |
| 8 | Face width |
| 9 | Forehead |
| 10 | Jaw width |
| 11 | Horizontal |
| 12 | Diagonal |
| 14 | Eye span in |
| 15 | Eye span out |
| 17 | Nose length |
| 19 | Ear length |

The stylist makes a number of observations of a more qualitative nature but easily accomplished when the stylist directs his attention to each feature individually for a more reliable observation.

These observations are:

| | | |
|---|---|---|
| 13 | Forehead shape | 1/Normal 2/Angle 3/Full |
| 16 | Eye Symmetry | 1/Symmetrical 2/Asymmetrical |
| 18 | Nose bend | 1/LR 2/LL 3/AR 4/AL |
| 20 | Ear symmetry | 1/Symmetrical 2/Asymmetrical |
| 21 | Hairline | 1/Strong 2/Weak |
| 22 | Hair texture | 1/FC 2/FS 3/FW 4/MC 5/MS 6/MW 7/CC 8/CS 9/CW |
| 23 | Glasses worn | 1/Worn 2/Not worn |

Each of the physical measurements taken with the caliper 10, and height stick 11 are compared with a standardized measuring stick 12 having uniform length graduations. These length graduations may be standard centimeters, or as we have determined, a standard interval in the order of ⅛ inch inch and 0.32 centimeters, to be particularly useful. The measurements are entered in a tabular record 13 as are the physical observations 13, 16, 18, and 20–23 above, as well as the height measurement 1.

The tabulated data along with subject identification data is next entered into the computer of FIG. 2 for processing in accordance with this invention to provide an analysis of the more than 94,000 possible combinations of input data, to provide a subject analysis for use by the stylist.

The computer, generally designated 15 in FIG. 2, employs typically a keyboard 16 and a numeric key pad 20 shown for convenience with an integrated video display 21. The computer and memory 22 and a printer 23 or other type of output device such as a modem for connection into a communications channel make up the computer system. It must be recognized that given the relationship set forth below the stylist might manually calculate the guidance criteria however the speed of a modern digital computer virtually mandates its use in rapidly producing the required guidance criteria.

The computer 15 under the control of its program described below makes the required calculation in comparison in accordance with the program and produces a printout of guidance for the stylist. The printout of information constitutes an analysis of this subject as compared with measured population averages as a starting point for the stylist. A typical readout for an actual subject is as follows:

| CRITERIA | | |
|---|---|---|
| 1. | height | short |
| 2. | shoulder ratio | average |
| 3. | neck ratio | average |
| 4. | ear protrusion | average |
| 5. | forehead/jaw width | average |
| 6. | front view | inverted triangular face |
| 7. | horizontal ratio | long |
| 8. | diagonal ratio | long |
| 9. | shape of forehead | angular |
| 10. | eye span ratio | wide |
| 11. | eyes | asymmetrical |
| 12. | nose length | normal |
| 13. | nose bend | light left |
| 14. | ear ratio | short |
| 15. | ear symmetry | asymmetrical |
| 16. | hair line | strong |
| 17. | hair texture | medium and straight |
| 18. | glasses | worn |

Thus, the stylist is furnished with basic information on the subject which prior to this invention is only subjectively considered and usually with many of the criteria overlooked.

The method of this invention is illustrated in FIG. 3 which is a generalized flow diagram for the method Steps A, B, C and F, G, and H are preferably performed by a general purpose computer properly programmed. The calculations may be made manually, however the speed and versatility warrants the use of a computer.

The computer further furnishes to the stylist specific recommendations in order to:

(a) highlight attractive features of the subject;

(b) define the hair cut style requirements from front, rear, and profile views;

(c) determine where the volume of hair must be the thickest; and (d) provide options.

Figure 8:
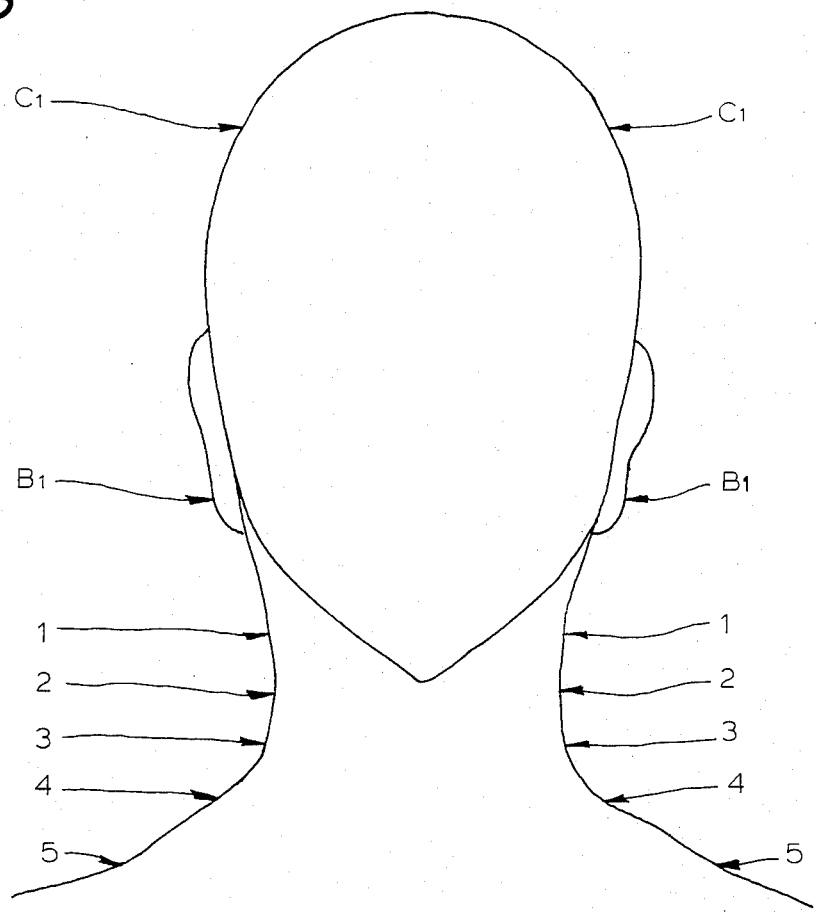
FIG. 8 is a rear elevational view similar to FIGS. 6 and 7.

An example of recommendations furnished for an actual subject are as follows:

| | Objective | Reference to FIGS. |
|---|---|---|
| 1 Back View | Create Height | Length to 1 or 2-3 V-cut or 1 U-shape, FIG. 8 |
| 2 Front View (Inverted triangular face) | Narrow forehead/Widen jawline | Some hair volume at D; No volume at C2 to A2; Maximum volume E2 to F2 Per FIG. 6 Part, Center or Near Center |
| 3 Profile View | Shorten horizontal lines to build up face. | Lines tend to counterbalance each other. Some volume at E and E. Per FIG. 7 |
| 4 Eye Span | Shorten Span | Use center or near center part - less volume at at eye level, facial symmetry recommendation has priority. |
| 5 Eye Symmetry | Maintain | Eyes are not of even height - left is lower, direct hair and volume towards lower eye, forward onto forehead. |
| 6 Nose Length | Maintain | Well proportioned |
| 7 Nose Bent | Soften bend to left. | Move flow of style to right. |
| 8 Ears length | Maintain | Ears are short but do not handicap style - may be exposed. |
| 9 Ear Symmetry | Be Alert | Be aware ear lobes are not at same height, left ear is lower - while cutting make allowance to keep cut symmetrical. |
| 10 Hair line | Strong | This makes possible to have more volume around face, can enjoy short necklines. |
| 11 Hair Texture and Type | Ideal for long Hair | Needs permanent for stylibility and curl retention; hair color may be used to make it look less bulky. |
| 12 Glasses | Inverted Triangle | If worn, wear triangular frames, wider bottom and narrow top. |

Figure 6:
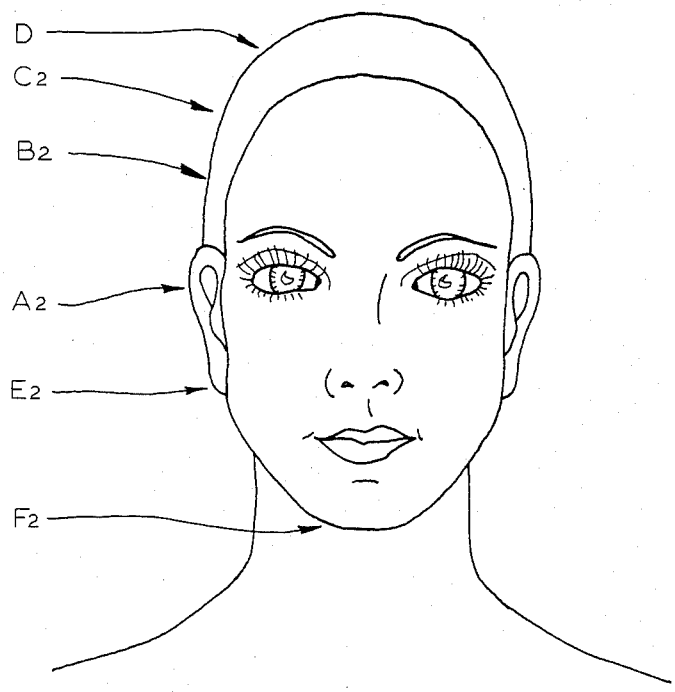
FIG. 6 is a front elevational view of a standard subject with certain head locations identified for use in the visual presentation of possible hair styles.
Figure 7:
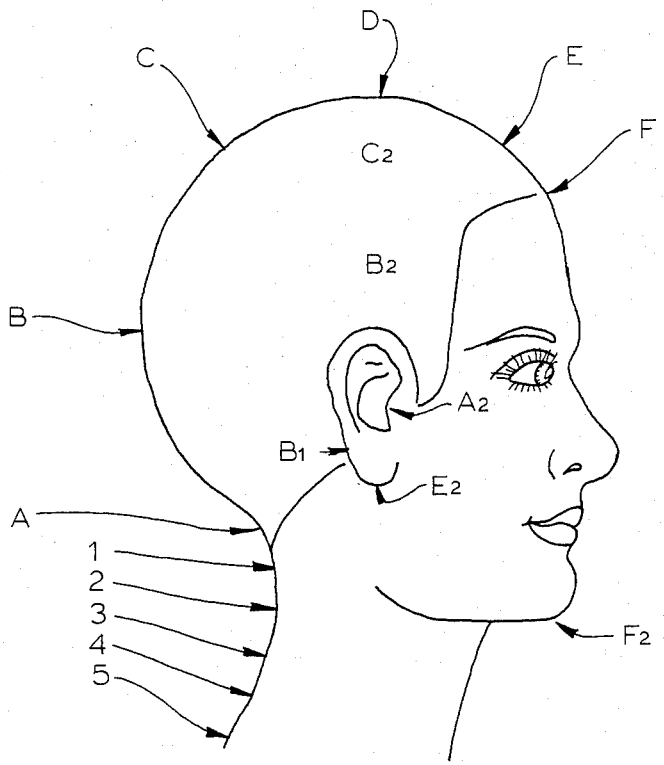
FIG. 7 is a profile view of a subject model similar to FIG. 6.

Given the above recommendations, the hair stylist may use the charts of FIGS. 6, 7 and 8 to produce graphically the various volumes of hair at different locations for his own evaluation and review prior to styling. Thus, the stylist now has before him valuable aid to his own ability based upon his own precise measurements and observations with the aid of computational capabilities of a computer. Of additional importance is that the customer for the first time has a true picture of her own facial characteristics and an understanding of hair styling compatable with her particular face.

FUNDAMENTALS OF THE INVENTION

Front View Relationships

As a part of our study of many subjects we developed norms against which the actual measurements of the subject are taken and the various ratios may be compared. As an example, the shape of the face of the subject may be any of twelve different shapes described below. This is in contrast with the commonly accepted notion that there only four shapes, round, oval, rectangular, and triangle.

The actual measurements taken as shown in FIG. 1 provide the raw data. We have found that the ratios of the head length to width and forehead to jaw determine the twelve shapes where $LW_R$ equals the head length to width ratio and $FJ_R$ equals the forehead to jaw ratio. The face shapes and these ratios are typified by the first relationship.

| RELATIONSHIP | FACE | OBJECTIVE |
|---|---|---|
| (1) $LW_R$ is greater than 1.46 and $FJ_R$ is greater than 1.55 | SHAPE inverted triangular | shorten face, build up low half of face, narrow forehead. RECOMMENDATION hair is no shorter than $E_2$ on FIG. 6 with maximum volume between $A_2$ and; suggested length from $E_2$ to 2 or 3 in back using concave neck. Part at center or near. Fill in R. Keep above $A_2$ to narrow and no volume at D. One length cut. |

Each of the remaining combinations appears in the accompanying computer program.

Back View Relationships

The back view relations include the height of the subject, the shoulder ratio $S_R$ which is the ratio of the shoulder width to the head width:

The neck ratio $N_R$ which is the ratio of the neck length 4—4 to the head length 7—7 and to the ear protrusion $E_P$.

Again, twenty seven different combinations of relationships of these factors occur. They are typified by the first relationship:

| | OBJECTIVE | RECOMMENDATION |
|---|---|---|
| (1) - The subject's height H is greater than 67 inches; $S_R$ is less than 2.4; and $N_R$ is greater than 0.82. | Build up vol. for width, shorten the neck. | Suggested length to 2 or 3 on FIG. 8. Use str. cut. |

The remaining twenty six combinations are set forth in the accompanying computer program.

Additional Data Entry

The additional measurements and observations which were made on the subject provide additional inputs to the system. The first such additional input is the eye span ratio, $S_R$ which is the ratio of the measurement of the distance between the inner edges of the eyes to the span to the outer edges of the eyes. A ratio of 0.31 to 0.35 is normal. Eye span ratios of 0.31 or less denote narrow eye span, and those greater than 0.35 denote wide spans.

The operator also determines any asymmetrical location of the eye. One eye is commonly slightly above the other and hardly noticeable but having a significant effect upon the appearance of the subject when styled unless recognized and compensated for in styling.

The nose length ratio measured from the tip of the nose to the start of the bridge as compared with the face length is significant. Nose ratio $N_R$ is the ratio of the nose length to the face length. A normal nose length ranges between 0.260 to 0.3 of the face length and a shorter than 0.260 and provides a short nose and that longer than 0.30 is characterized as a long nose.

The stylist upon specific attention directed to the subject can observe whether the subject's nose bends either lightly or acutely to either direction providing four other possible inputs of data: light left (LL); light right (LR); acute left (AL); and acute right (AR).

Ear protrusion $E_p$ between 0.320 to 0.380 is normal with the extremes on either side being indicative of either short or wide protrusion. A particular significant factor with respect to ears is whether they are asymmetrical with respect to vertical placement on the subject's head. Since the lower tip of the ear is usually used as a reference point for determining a hair line and if asymmetry exists the hair line can be miscut.

The hair line of the subject being either strong or weak, likewise is a significant input factor.

The hair texture and type is significant there being at least nine variations from fine/curly to fine/straight fine/wavy, medium/curly, medium/straight, medium/-wavy and course/curly, course/straight and course/-wavy. Each of these are easily qualitively ascertained by the stylist.

Another factor is whether the subject wears glasses or not and it provides a basis for the determining hair style and if glasses are worn the style of frames which complement the appearance of the subject.

When each of the inputs with respect to the front profile and additional data inputs are introduced into a computer programmed in accordance with this invention the output provides guidance for the stylist previously unavailable. As an example, the additional data input provided above, gives guidance as follows:

| OBJECTIVE | RECOMMENDATION |
|---|---|
| Eye Span | |
| (1) - Shorten span. | Use center part or very near - less volume at eye level. Facial symmetry recommendation has priority. |
| (2) - Widen span. | Comb hair away from face on sides - more volume at eye level. Facial symmetry recommendation has priority. |
| (3) - Maintain. | Eye span is in good proportion - therefore does not affect hair style. |
| Eye Symmetry | |
| (1) - Maintain. | Eyes are symmetrical. Therefore does not affect hair style. |
| (2) - Make eyes look even. | Eyes are not even and therefore recommend to direct hair volume towards lower eye - forward onto forehead. |
| Nose Length | |
| (1) - Maintain. | Nose is well proportioned, and does not affect hair style. |
| (2) - Maintain. | Your nose is short in proportion to the face, but is not a handicap - profile may appear narrower so that recommendation for profile symmetry should be followed. |
| (1) - Soften bend. | Nose is slightly bent to the left - move flow of style to right. |

Profile Relationships

Figure 5:
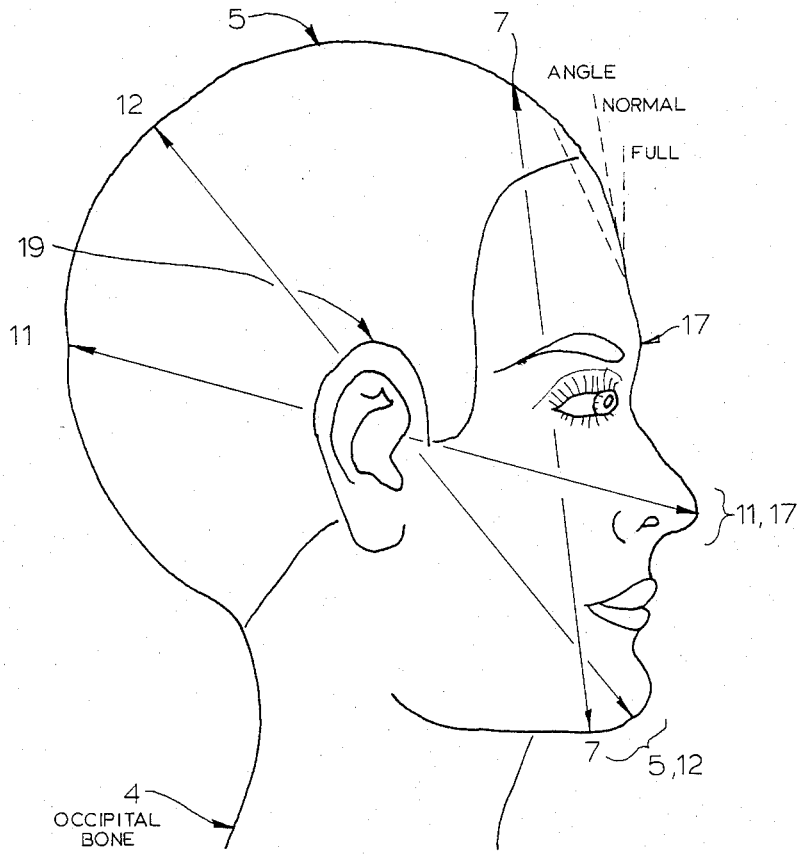
FIG. 5 is a graphical presentation of certain additional measurements to be taken of the subject.

The measurements which principally affect the profile view are the horizontal ratio, $H_R$ which is the ratio in FIG. 5 of length 11—11 to 7—7; the diagonal ratio, $D_R$ of the ratio in FIG. 5 of length 12—12 to 7—7; and the forehead shape, whether normal, angle or full as illustrated in FIG. 5.

Twenty seven different profile relationships are possible. They are similar in general respects to the representative relationships set forth for the front view. We find an optimum or normal values as follows for profile measurements.

$1.032 < H_R < 1.168$ $1.198 < D_R < 1.435$ and

Figure 4:
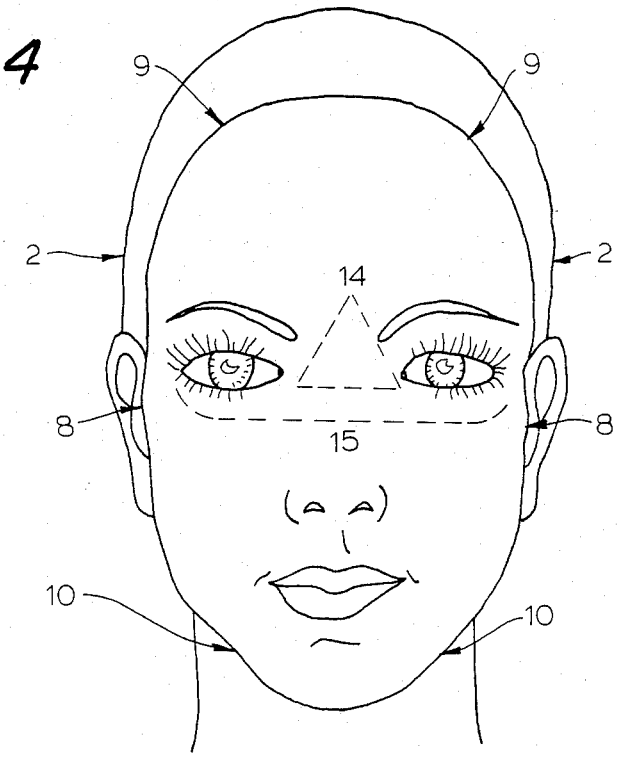
FIG. 4 is a graphical presentation of certain of the measurements to be taken of the subject.

Forehead normal as shown in FIG. 4.

Outside these standards asymmetry exists and the stylist needs guidance. The twenty seven possible combinations of these three variables give rise to twenty seven different recommendations, examples of which are:

| Combinations | Objective | Recommendation |
|---|---|---|
| (1) $H_R$ is greater than 1.032 but less than 1.168, $D_R$ is greater than 1.198 but less than 1.435; and forehead is normal. | Maintain proper balance. | Even distribution at nose from E to B on FIG. 7. |

The full set of relationships and resultant recommendations for the profile are set forth in the accompanying computer program in the Basic language. The program is incorporated by reference as a part of this specification.

The above described embodiments of this invention are merely descriptive of its principles and are not to be considered limiting. The scope of this invention instead shall be determined from the scope of the following claims, including their equivalents.

In accordance with 954 O.G.550, 37 CFR Part 1. Rule of Practice 1.96, Approved June 7, 1977, accompanying herewith and incorporated by reference is the listing of the computer program referenced in the foregoing specifications, the listing consisting of 28 printed pages.

```
0010 REM THIS IS THE FIRST IN A SERIES OF SYMMETRY ANALYSIS
0020 REM PROGRAMS FOR BRODEUR INC.  THIS PROGRAM PRINTS A COVER
0030 REM PAGE AND INTRO LETTER FOR A CUSTOMER PORTFOLIO.
0040 REM WRITTEN ON 4-14-78.  LAST UPDATE ON 02-23-79.
0050 REM PROGRAM AUTHOR: WALT BRUBAKER
0060 USE A(25),A$,B$
0070 GOSUB 2250
0080 PRINT 'XXX      XXX     XXXXXXXXXXX     XXXXXXXXX     XXXXXXXX'
0090 PRINT 'XXX      XXX     XXXXXXXXXXX     XXXXXXXXX     XXXXXXXXX'
0100 PRINT 'XXX      XXX     XXX      XXX       XXX        XXX      XX'
0110 PRINT 'XXX      XXX     XXX      XXX       XXX        XXX     XXX'
0120 PRINT 'XXX      XXX     XXX      XXX       XXX        XXX     XXX'
0130 PRINT 'XXX      XXX     XXX      XXX       XXX        XXXXXXXXX'
0140 PRINT 'XXXXXXXXXXX      XXXXXXXXXXX       XXX        XXXXXXXX'
0150 PRINT 'XXXXXXXXXXX      XXXXXXXXXXX       XXX        XXXXXXX'
0160 PRINT 'XXX      XXX     XXX      XXX       XXX        XXX    XXX'
0170 PRINT 'XXX      XXX     XXX      XXX       XXX        XXX    XXX'
0180 PRINT 'XXX      XXX     XXX      XXX       XXX        XXX    XXX'
0190 PRINT 'XXX      XXX     XXX      XXX     XXXXXXXXX    XXX    XXX'
0200 PRINT 'XXX      XXX     XXX      XXX     XXXXXXXXX    XXX    XXX'
0210 FOR X=1 TO 400
0220 NEXT X
0230 PRINT
0240 PRINT
0250 PRINT
0260 PRINT '  ######          #####          #####          #####'
0270 PRINT '########        #######        #######        #######'
0280 PRINT '##      #####   ##      ##     ##      ##     ##      ##'
0290 PRINT '#         ###   ###     ###    ###     ###    ###     ###'
0300 PRINT '        #####   ###     ###    ###     ###    ###     ###'
0310 PRINT '       #####    ###     ###    ###     ###    ###     ###'
0320 PRINT '      #####     ###     ###    ###     ###    ###     ###'
0330 PRINT '    #####       ##      ##     ##      ##     ##      ##'
0340 PRINT '   #####        #######        #######        #######'
0350 PRINT '##############    ###            ###            ###'
0360 PRINT '##############  '
0370 FOR X=1 TO 500
0380 NEXT X
0390 REM THIS SUBROUTINE PRINTS RANDOM NUMBERS AS A VISUAL
0400 REM DISPLAY BETWEEN QUESTIONS.
0410 FOR X4=1 TO 30
0420 X2=RND*100
0430 X3=RND*100
0440 PRINT TAB(X2),X3
0450 FOR X=1 TO 20
0460 NEXT X
0470 NEXT X4
0480 GOSUB 2250
0490 PRINT '              SYMMETRY ANALYSIS'
0500 PRINT '                  HAIR 2000'
0510 PRINT
0520 PRINT 'ENTER CUSTOMER NAME IN QUOTES'
0530 PRINT '''                    ''';
0540 INPUT B$
0550 PRINT 'ENTER CUSTOMER PHONE NUMBER  (IN QUOTES)'
0560 PRINT '''                    ''';
0570 INPUT C$
0580 PRINT 'ENTER THE DATE  (IN QUOTES)'
0590 PRINT '''                    ''';
0600 INPUT A$
0610 PRINT 'ENTER THE SALON NAME  (IN QUOTES)'
0620 PRINT '''                    ''';
0630 INPUT D$
```

```
0640 PRINT 'ENTER THE ADDRESS  (IN QUOTES)'
0650 PRINT '''                          ''';
0660 INPUT E$
0670 PRINT 'ENTER THE CITY/STATE  (IN QUOTES)'
0680 PRINT '''                          ''';
0690 INPUT F$
0700 GOSUB 2250
0710 FOR X=1 TO 5
0720 PRINT FLP,
0730 NEXT X
0740 PRINT FLP,TAB(28)'S Y M M E T R Y'
0750 PRINT FLP,
0760 PRINT FLP,TAB(26)'A COMPUTERIZED ANALYSIS'
0770 FOR X=1 TO 20
0780 PRINT FLP,
0790 NEXT X
0800 PRINT FLP,TAB(20)'**********************************************'
0810 PRINT FLP,TAB(20)'**                                          **'
0820 PRINT FLP,' ';
0830 PRINT USING FLP,0840,B$
0840 :                    **        FOR: ####################       **
0850 PRINT FLP,TAB(20)'**            ';C$;TAB(58)'**'
0860 PRINT FLP,TAB(20)'**********************************************'
0870 FOR X=1 TO 13
0880 PRINT FLP,
0890 NEXT X
0900 PRINT FLP,TAB(5)'PRESENTED BY:'
0910 PRINT FLP,
0920 PRINT FLP,TAB(8);D$
0930 PRINT FLP,TAB(9);E$
0940 PRINT FLP,TAB(9);F$
0950 PRINT FLP,
0960 PRINT FLP,
0970 PRINT FLP,TAB(25);A$
0980 FOR X=1 TO 4
0990 PRINT FLP,
1000 NEXT X
1010 PRINT FLP,TAB(50)'(C) 1978 JACQUES BRODEUR'
1020 FOR X=1 TO 18
1030 PRINT FLP,
1040 NEXT X
1050 X=5
1060 PRINT FLP,TAB(X)'DEAR ';B$
1070 PRINT FLP,
1080 PRINT 'DEAR ';B$
1090 PRINT FLP,
1100 GOSUB 2290
1110 PRINT ' '
1120 PRINT FLP,TAB(X+5)'YOU ARE ABOUT TO DISCOVER A NEW ';
1130 PRINT 'YOU ARE ABOUT TO DISCOVER A NEW ';
1140 PRINT FLP,'DIMENSION IN BEAUTY ENHANCEMENT!'
1150 PRINT 'DIMENSION IN BEAUTY ENHANCEMENT!'
1160 PRINT FLP,
1170 GOSUB 2290
1180 PRINT FLP,TAB(X)'BY ENRICHING YOUR KNOWLEDGE ABOUT YOUR ';
1190 PRINT 'BY ENRICHING YOUR KNOWLEDGE ABOUT YOUR ';
1200 PRINT FLP,'INDIVIDUAL BONE STRUCTURE, AS'
1210 PRINT FLP,
1220 PRINT 'INDIVIDUAL BONE STRUCTURE'
1230 GOSUB 2290
1240 PRINT FLP,TAB(X)'WELL AS HEAD AND FACIAL PROPORTIONS,';
1250 PRINT 'AS WELL AS HEAD AND FACIAL PROPORTIONS,';
```

```
1260 PRINT FLP,'YOU WILL NOW BECOME AWARE OF'
1270 PRINT FLP,
1280 PRINT ' YOU WILL NOW BECOME'
1290 GOSUB 2290
1300 PRINT FLP,TAB(X)'BASIC PRINCIPLES THAT DETERMINE WHICH ';
1310 PRINT 'AWARE OF THE BASIC PRINCIPLES';
1320 PRINT FLP,'HAIRSTYLE LOOKS BEST ON YOU.'
1330 PRINT FLP,
1340 PRINT ' THAT DETERMINE WHICH HAIRSTYLE'
1350 PRINT 'LOOKS BEST ON YOU. NO MATTER HOW STYLES CHANGE'
1360 GOSUB 2290
1370 PRINT FLP,TAB(X)'NO MATTER HOW STYLES CHANGE, YOU CAN ';
1380 PRINT 'YOU CAN ADAPT THEM TO MEET YOUR OWN';
1390 PRINT FLP,'ADAPT THEM TO MEET YOUR OWN'
1400 PRINT FLP,
1410 PRINT ' REQUIREMENTS--BY VIRTUE OF'
1420 GOSUB 2290
1430 PRINT FLP,TAB(X)'REQUIREMENTS--BY VIRTUE OF THE PRINCIP';
1440 PRINT FLP,'LES CONTAINED IN THIS PORTFOLIO.'
1450 PRINT FLP,
1460 PRINT 'THE PRINCIPLES CONTAINED IN THIS PORTFOLIO.'
1470 GOSUB 2290
1480 PRINT FLP,TAB(X+5)'WE CALL THIS DEFINITION OF SUCH';
1490 PRINT '   WE CALL THIS DEFINITION OF SUCH';
1500 PRINT FLP,' BEAUTY CHARACTERISTICS'
1510 PRINT ' BEAUTY CHARACTERISTICS'
1520 PRINT FLP,
1530 GOSUB 2290
1540 PRINT FLP,TAB(X)'''SYMMETRY.''  SYMMETRY MEANS THE RIGHT';
1550 PRINT '''SYMMETRY.''  SYMMETRY MEANS THE RIGHT';
1560 PRINT FLP,' DISTRIBUTION OF WEIGHT AND'
1570 PRINT ' DISTRIBUTION OF WEIGHT AND'
1580 PRINT FLP,
1590 GOSUB 2290
1600 PRINT FLP,TAB(X)'VOLUME OF HAIR TO CREATE THE SPECIAL';
1610 PRINT 'VOLUME OF HAIR TO CREATE THE SPECIAL';
1620 PRINT FLP,' ''FRAMING'' EFFECTS BEST FOR'
1630 PRINT ' ''FRAMING'' EFFECTS BEST FOR'
1640 PRINT FLP,
1650 GOSUB 2290
1660 PRINT FLP,TAB(X)'YOUR OWN SPECIAL NEEDS.'
1670 PRINT 'YOUR OWN SPECIAL NEEDS.'
1680 PRINT FLP,
1690 GOSUB 2290
1700 PRINT FLP,TAB(X+5)'CENTURIES AGO, THE WORLD''S GREATEST';
1710 PRINT '   CENTURIES AGO, THE WORLD''S GREATEST';
1720 PRINT FLP,' PAINTERS AND SCULPTORS'
1730 PRINT FLP,
1740 PRINT ' PAINTERS AND SCULPTORS'
1750 GOSUB 2290
1760 PRINT FLP,TAB(X)'DEFINED BASIC STANDARDS FOR HUMAN BEAUTY';
1770 PRINT 'DEFINED BASIC STANDARDS FOR HUMAN BEAUTY';
1780 PRINT FLP,' IN ART. TODAY, THESE'
1790 PRINT FLP,
1800 PRINT ' IN ART. TODAY, THESE'
1810 GOSUB 2290
1820 PRINT FLP,TAB(X)'SAME PRINCIPLES HAVE BEEN ADAPTED TO';
1830 PRINT 'SAME PRINCIPLES HAVE BEEN ADAPTED TO';
1840 PRINT FLP,' COMPUTER SCIENCE--IN A UNIQUE'
1850 PRINT FLP,
1860 PRINT ' COMPUTER SCIENCE--IN A'
1870 GOSUB 2290
```

```
1880 PRINT FLP,TAB(X)'PROGRAM DEVELOPED BY SYMMETRY 2000.'
1890 PRINT FLP,
1900 PRINT 'UNIQUE PROGRAM DEVELOPED BY SYMMETRY 2000.'
1910 GOSUB 2290
1920 PRINT FLP,TAB(X+5)'THE DATA YOU WILL PROVIDE';
1930 PRINT '   THE DATA YOU WILL PROVIDE';
1940 GOSUB 2290
1950 PRINT FLP,' FORMS THE BASIS OF THESE'
1960 PRINT FLP,
1970 PRINT ' FORMS THE BASIS OF THESE SCIENTIFIC'
1980 GOSUB 2290
1990 PRINT FLP,TAB(X)'SCIENTIFIC INSIGHTS--RESULTING IN A';
2000 PRINT 'INSIGHTS--RESULTING IN A';
2010 GOSUB 2290
2020 PRINT FLP,' SERIES OF TECHNIQUES AND APPROACHES'
2030 PRINT FLP,
2040 PRINT ' SERIES OF TECHNIQUES AND APPROACHES'
2050 GOSUB 2290
2060 PRINT FLP,TAB(X)'TO HAIR WHOSE USAGE WILL PROVE';
2070 PRINT 'TO HAIR WHOSE USAGE WILL PROVE';
2080 GOSUB 2290
2090 PRINT FLP,' INVALUABLE TO BOTH YOU AND YOUR'
2100 PRINT FLP,
2110 PRINT ' INVALUABLE TO BOTH YOU AND'
2120 GOSUB 2290
2130 PRINT FLP,TAB(X)'HAIRDRESSER, DAY AFTER DAY, YEAR AFTER YEAR!
2140 PRINT 'YOUR HAIRDRESSER, DAY AFTER DAY, YEAR AFTER YEAR!'
2150 GOSUB 2290
2160 FOR X=1 TO 9
2170 PRINT FLP,
2180 NEXT X
2190 PRINT FLP,TAB(50),'(C) 1978 JACQUES BRODEUR'
2200 GOSUB 2250
2210 FOR X=1 TO 10
2220 PRINT FLP,
2230 NEXT X
2240 CHAIN 'E80',2
2250 FOR X=1 TO 15
2260 PRINT
2270 NEXT X
2280 RETURN
2290 FOR X1=1 TO 500
2300 NEXT X1
2310 RETURN
0010 REM THIS IS THE SECOND IN A SERIES OF SYMMETRY ANALYSIS
0020 REM PROGRAMS WRITTEN FOR BRODEUR INC.  THIS PROGRAM INPUTS
0030 REM THE PERTINENT MEASUREMENTS OF THE CUSTOMER.
0040 REM DATE-WRITTEN. 04-14-78.
0050 REM PROGRAMMER. WALT BRUBAKER.
0060 USE A(25),A$,B$
0070 GOSUB 8000
0080 PRINT 'ENTER THE HEIGHT'
0090 INPUT X1
0100 IF X1>67&X1<100 GOTO 0150
0110 IF X1≥63&X1≤67 GOTO 0170
0120 IF X1<63&X1>0 GOTO 0190
0130 GOSUB 9500
0140 GOTO 0080
0150 A(1)=1
0160 GOTO 0200
0170 A(1)=2
0180 GOTO 0200
0190 A(1)=3
```

```
0200 GOSUB 8000
0210 PRINT 'ENTER THE TEMPORAL HEAD WIDTH'
0220 INPUT X1
0225 IF X1≤0 GOTO 0210
0230 PRINT 'ENTER THE SHOULDER WIDTH'
0240 INPUT X2
0250 IF X2/X1>2.6&X2/X1<10 GOTO 0300
0260 IF X2/X1≥2.4&X2/X1≤2.6 GOTO 0320
0270 IF X2/X1<2.4&X2/X1>0 GOTO 0340
0280 GOSUB 9500
0290 GOTO 0210
0300 A(2)=1
0310 GOTO 0350
0320 A(2)=2
0330 GOTO 0350
0340 A(2)=3
0350 GOSUB 8000
0360 PRINT 'ENTER THE NECK HEIGHT'
0370 INPUT X1
0380 PRINT 'ENTER THE HEAD HEIGHT'
0390 INPUT X2
0395 IF X2≤0 GOTO 0380
0400 IF X1/X2>.8625&X1/X2<5 GOTO 0450
0410 IF X1/X2≥.4625&X1/X2≤.8625 GOTO 0470
0420 IF X1/X2<.4625&X1/X2>0 GOTO 0490
0430 GOSUB 9500
0440 GOTO 0360
0450 A(3)=1
0460 GOTO 0500
0470 A(3)=2
0480 GOTO 0500
0490 A(3)=3
0500 GOSUB 8000
0510 PRINT 'ENTER THE DISTANCE BETWEEN THE EARS'
0520 INPUT X1
0530 IF X1>6.7&X1<25 GOTO 0570
0540 IF X1≤6.7&X1>0 GOTO 0590
0550 GOSUB 9500
0560 GOTO 0510
0570 A(4)=1
0580 GOTO 0600
0590 A(4)=2
0600 GOSUB 8000
0610 PRINT 'ENTER THE LENGTH OF CHIN TO HAIR LINE'
0620 INPUT X3
0625 IF X3≤0 GOTO 0610
0630 PRINT 'ENTER THE FACE WIDTH'
0640 INPUT X2
0645 IF X2≤0 GOTO 0630
0650 IF X3/X2>1.46&X3/X2<5 GOTO 0700
0660 IF X3/X2≥1.25&X3/X2≤1.46 GOTO 0720
0670 IF X3/X2<1.25&X3/X2>0 GOTO 0740
0680 GOSUB 9500
0690 GOTO 0610
0700 A(5)=1
0710 GOTO 0750
0720 A(5)=2
0730 GOTO 0750
0740 A(5)=3
0750 GOSUB 8000
0760 PRINT 'ENTER THE FOREHEAD WIDTH'
0770 INPUT X1
```

```
0780 PRINT 'ENTER THE JAW WIDTH'
0790 INPUT X2
0795 IF X2≤0 GOTO 0780
0800 IF X1/X2>1.55&X1/X2<5 GOTO 0860
0810 IF X1/X2≥1.25&X1/X2≤1.55 GOTO 0880
0815 IF X1/X2≥1.15&X1/X2<1.25 GOTO 0890
0820 IF X1/X2<1.15&X1/X2≥.95 GOTO 0900
0830 IF X1/X2<.95&X1/X2>0 GOTO 0920
0840 GOSUB 9500
0850 GOTO 0760
0860 A(6)=1
0870 GOTO 0930
0880 A(6)=2
0885 GOTO 0930
0890 A(6)=3
0895 GOTO 0930
0900 A(6)=4
0910 GOTO 0930
0920 A(6)=5
0930 GOSUB 8000
0940 PRINT 'ENTER THE LENGTH FROM NOSE TO OCCIPITAL'
0950 INPUT X1
0960 IF X1/X3>1.168 GOTO 1010
0970 IF X1/X3≥1.032&X1/X3≤1.168 GOTO 1030
0980 IF X1/X3<1.032&X1/X3>0 GOTO 1050
0990 GOSUB 9500
1000 GOTO 0940
1010 A(7)=1
1020 GOTO 1060
1030 A(7)=2
1040 GOTO 1060
1050 A(7)=3
1060 GOSUB 8000
1070 PRINT 'ENTER THE LENGTH FROM CHIN TO PARIETAL'
1080 INPUT X1
1090 IF X1/X3>1.435&X1/X3<10 GOTO 1140
1100 IF X1/X3≥1.198&X1/X3≤1.435 GOTO 1160
1110 IF X1/X3<1.198&X1/X3>0 GOTO 1180
1120 GOSUB 9500
1130 GOTO 1070
1140 A(8)=1
1150 GOTO 1190
1160 A(8)=2
1170 GOTO 1190
1180 A(8)=3
1190 GOSUB 8000
1200 PRINT 'ENTER THE OPTION: '
1210 PRINT '      1)-- NORMAL FOREHEAD'
1220 PRINT '      2)-- ANGULAR FOREHEAD'
1230 PRINT '      3)-- FULL FOREHEAD'
1240 INPUT X1
1250 IF X1>0&X1<4 GOTO 1280
1260 GOSUB 8000
1270 GOTO 1200
1280 A(9)=X1
1290 GOSUB 8000
1300 PRINT 'MEASURE EYE SPAN, INNER CORNER TO INNER CORNER.'
1310 INPUT X1
1315 IF X1≤0 GOTO 1300
1320 PRINT 'ENTER THE DISTANCE FROM OUTER CORNER OF RIGHT '
1325 PRINT 'EYE TO OUTER CORNER OF LEFT EYE.'
1330 INPUT X2
```

```
1335 IF X2≤0 GOTO 1320
1340 IF X1/X2≥.35&X1/X2<10 GOTO 1390
1350 IF X1/X2<.35&X1/X2>.31 GOTO 1410
1360 IF X1/X2≤.31&X1/X2>0 GOTO 1430
1370 GOSUB 9500
1380 GOTO 1300
1390 A(10)=1
1400 GOTO 1440
1410 A(10)=2
1420 GOTO 1440
1430 A(10)=3
1440 GOSUB 8000
1450 PRINT 'ENTER THE OPTION:'
1460 PRINT TAB(10)'1)-- EYES SYMMETRICAL'
1470 PRINT TAB(10)'2)-- EYES ASYMMETRICAL'
1480 INPUT X1
1490 IF X1>0&X1<3 GOTO 1520
1500 GOSUB 9500
1510 GOTO 1450
1520 A(11)=INT(X1)
1530 GOSUB 8000
1540 PRINT 'ENTER THE LENGTH OF NOSE FROM TIP TO BRIDGE'
1550 INPUT X1
1560 IF X1/X3≥.3&X1/X3<5 GOTO 1610
1570 IF X1/X3>.26&X1/X3<.3 GOTO 1630
1580 IF X1/X3≤.26&X1/X3>0 GOTO 1650
1590 GOSUB 9500
1600 GOTO 1540
1610 A(12)=1
1620 GOTO 1660
1630 A(12)=2
1640 GOTO 1660
1650 A(12)=3
1660 GOSUB 8000
1670 PRINT 'ENTER THE OPTION:'
1680 PRINT TAB(10)'1)-- NOSE BENDS LIGHTLY TO RIGHT'
1690 PRINT TAB(10)'2)-- NOSE BENDS LIGHTLY TO LEFT'
1700 PRINT TAB(10)'3)-- NOSE BENDS ACUTELY TO RIGHT'
1710 PRINT TAB(10)'4)-- NOSE BENDS ACUTELY TO LEFT'
1720 INPUT X1
1730 IF X1>0&X1<5 GOTO 1760
1740 GOSUB 9500
1750 GOTO 1670
1760 A(13)=INT(X1)
1770 GOSUB 8000
1780 PRINT 'ENTER THE VERTICAL HEIGHT OF THE EAR'
1790 INPUT X1
1800 IF X1/X3>.36&X1/X3<5 GOTO 1850
1810 IF X1/X3≥.32&X1/X3≤.36 GOTO 1870
1820 IF X1/X3<.32&X1/X3>0 GOTO 1890
1830 GOSUB 9500
1840 GOTO 1780
1850 A(14)=1
1860 GOTO 1900
1870 A(14)=2
1880 GOTO 1900
1890 A(14)=3
1900 GOSUB 8000
1910 PRINT 'ENTER THE OPTION:'
1920 PRINT TAB(10)'1)-- EARS SYMMETRICAL'
1930 PRINT TAB(10)'2)-- EARS ASYMMETRICAL'
1940 INPUT X1
```

```
1950 IF X1>0&X1<3 GOTO 1980
1960 GOSUB 9500
1970 GOTO 1910
1980 A(15)=INT(X1)
1990 GOSUB 8000
2000 PRINT 'ENTER THE OPTION:'
2010 PRINT TAB(10)'1)-- HAIRLINE STRONG'
2020 PRINT TAB(10)'2)-- HAIRLINE WEAK'
2030 INPUT X1
2040 IF X1>0&X1<3 GOTO 2070
2050 GOSUB 9500
2060 GOTO 2000
2070 A(16)=INT(X1)
2080 GOSUB 8000
2090 PRINT 'ENTER THE OPTION:  IS HAIR TEXTURE....'
2100 PRINT TAB(10)'1)-- FINE AND CURLY'
2110 PRINT TAB(10)'2)-- FINE AND STRAIGHT'
2120 PRINT TAB(10)'3)-- FINE AND WAVY'
2130 PRINT TAB(10)'4)-- MEDIUM AND CURLY'
2140 PRINT TAB(10)'5)-- MEDIUM AND STRAIGHT'
2150 PRINT TAB(10)'6)-- MEDIUM AND WAVY'
2160 PRINT TAB(10)'7)-- COARSE AND CURLY'
2170 PRINT TAB(10)'8)-- COARSE AND STRAIGHT'
2180 PRINT TAB(10)'9)-- COARSE AND WAVY';
2190 INPUT X1
2200 IF X1>0&X1<10 GOTO 2230
2210 GOSUB 9500
2220 GOTO 2090
2230 A(17)=INT(X1)
2240 GOSUB 8000
2250 PRINT 'ENTER THE OPTION:'
2260 PRINT TAB(10)'1)-- GLASSES WORN'
2270 PRINT TAB(10)'2)-- NO GLASSES WORN'
2280 INPUT X1
2290 IF X1>0&X1<3 GOTO 2320
2300 GOSUB 9500
2310 GOTO 2250
2320 A(18)=INT(X1)
2330 GOSUB 8000
2340 PRINT 'ALL ENTRIES CORRECT?  ENTER 1 FOR YES, 0 FOR NO
2350 INPUT X1
2360 IF X1=0 GOTO 0070
2370 CHAIN 'E80',3
8000 GOSUB 9000
8010 PRINT TAB(15)'S_Y_M_M_E_T_R_Y___A_N_A_L_Y_S_I_S'
8020 PRINT
8030 PRINT TAB(10)'***** DATA ENTRY FOR: 'B$;' ******'
8040 PRINT
8050 RETURN
9000 FOR X=1 TO 15
9010 PRINT
9020 NEXT X
9030 RETURN
9500 GOSUB 9000
9510 PRINT '*****************************************************'
9520 PRINT '*************| ERROR, TRY AGAIN |*************'
9530 PRINT '*****************************************************'
9540 PRINT
9550 RETURN
0010 REM THIS IS THE THIRD IN A SERIES OF SYMMETRY ANALYSIS
0030 REM PROGRAMS WRITTEN FOR BRODEUR INC.  THIS PROGRAM PRINTS
0050 REM THE FACIAL CHARACTERISTICS WHICH WERE INPUT BY THE LAST
```

```
0070 REM PROGRAM IN THE SERIES.
0090 REM DATE-WRITTEN. 04-27-78.
0110 REM PROGRAMMER. WALT BRUBAKER.
0130 USE A(25),A$,B$
0150 FOR X=1 TO 5
0170 PRINT FLP,
0190 NEXT X
0210 PRINT FLP,TAB(25);'C H A R A C T E R I S T I C S'
0230 PRINT FLP,
0250 PRINT FLP,TAB(25)'FOR: ';B$
0270 PRINT FLP,TAB(25)'DATE: ';A$
0290 FOR X=1 TO 4
0310 PRINT FLP,
0311 Z1=4
0330 NEXT X
0350 PRINT FLP,TAB(Z1);'C 1: HEIGHT: ';
0370 GOTO 0390,0430,0470 ON A(1)
0390 PRINT FLP,'TALL'
0410 GOTO 0490
0430 PRINT FLP,'AVERAGE'
0450 GOTO 0490
0470 PRINT FLP,'SHORT'
0490 PRINT FLP,
0510 PRINT FLP,TAB(Z1);'C 2: SHOULDER RATIO: ';
0530 GOTO 0550,0590,0630 ON A(2)
0550 PRINT FLP,'WIDE'
0570 GOTO 0650
0590 PRINT FLP,'AVERAGE'
0610 GOTO 0650
0630 PRINT FLP,'NARROW'
0650 PRINT FLP,
0670 PRINT FLP,TAB(Z1);'C 3: NECK RATIO: ';
0690 GOTO 0710,0750,0790 ON A(3)
0710 PRINT FLP,'LONG'
0730 GOTO 0810
0750 PRINT FLP,'AVERAGE'
0770 GOTO 0810
0790 PRINT FLP,'SHORT'
0810 PRINT FLP,
0830 PRINT FLP,TAB(Z1);'C 4: EAR PROTRUSION: ';
0850 GOTO 0870,0910 ON A(4)
0870 PRINT FLP,'WIDE'
0890 GOTO 0930
0910 PRINT FLP,'AVERAGE'
0930 PRINT FLP,
0950 PRINT FLP,TAB(Z1)'C 5: FOREHEAD-JAW WIDTH: ';
0970 GOTO 0990,1030,1070 ON A(5)
0990 PRINT FLP,'LONG'
1010 GOTO 1090
1030 PRINT FLP,'AVERAGE'
1050 GOTO 1090
1070 PRINT FLP,'SHORT'
1090 PRINT FLP,
1110 PRINT FLP,TAB(Z1);'C 6: FRONT VIEW: ';
1130 IF A(5)≠1 GOTO 1140
1135 GOTO 1180,1190,1200,1200,1210 ON A(6)
1140 IF A(5)≠2 GOTO 1150
1145 GOTO 1220,1230,1240,1240,1250 ON A(6)
1150 IF A(5)≠3 GOTO 1330
1155 GOTO 1260,1270,1270,1280,1290 ON A(6)
1170 GOTO 1330
1180 PRINT FLP,'LONG INVERTED TRIANGULAR FACE'
```

```
1185 GOTO 1330
1190 PRINT FLP,'LONG OVAL FACE'
1195 GOTO 1330
1200 PRINT FLP,'LONG RECTANGULAR FACE'
1205 GOTO 1330
1210 PRINT FLP,'LONG TRIANGULAR FACE'
1215 GOTO 1330
1220 PRINT FLP,'INVERTED TRIANGULAR FACE'
1225 GOTO 1330
1230 PRINT FLP,'PERFECT OVAL FACE'
1235 GOTO 1330
1240 PRINT FLP,'RECTANGULAR FACE'
1245 GOTO 1330
1250 PRINT FLP,'TRIANGULAR FACE'
1255 GOTO 1330
1260 PRINT FLP,'SHORT INVERTED TRIANGULAR FACE'
1265 GOTO 1330
1270 PRINT FLP,'ROUND FACE'
1275 GOTO 1330
1280 PRINT FLP,'SQUARE FACE'
1285 GOTO 1330
1290 PRINT FLP,'SHORT TRIANGULAR FACE'
1330 PRINT FLP,
1350 PRINT FLP,TAB(Z1);'C 7: HORIZONTAL RATIO: ';
1370 GOTO 1390,1430,1470 ON A(7)
1390 PRINT FLP,'LONG'
1410 GOTO 1490
1430 PRINT FLP,'NORMAL'
1450 GOTO 1490
1470 PRINT FLP,'SHORT'
1490 PRINT FLP,
1510 PRINT FLP,TAB(Z1);'C 8: DIAGONAL RATIO: ';
1530 GOTO 1550,1590,1630 ON A(8)
1550 PRINT FLP,'LONG'
1570 GOTO 1650
1590 PRINT FLP,'NORMAL'
1610 GOTO 1650
1630 PRINT FLP,'SHORT'
1650 PRINT FLP,
1670 PRINT FLP,TAB(Z1);'C 9: SHAPE OF FOREHEAD: '
1690 GOTO 1710,1750,1790 ON A(9)
1710 PRINT FLP,'NORMAL'
1730 GOTO 1810
1750 PRINT FLP,'ANGULAR'
1770 GOTO 1810
1790 PRINT FLP,'FULL'
1810 PRINT FLP,
1830 PRINT FLP,TAB(Z1);'C10: EYE SPAN RATIO: ';
1850 GOTO 1870,1910,1950 ON A(10)
1870 PRINT FLP,'WIDE'
1890 GOTO 1970
1910 PRINT FLP,'NORMAL'
1930 GOTO 1970
1950 PRINT FLP,'NARROW'
1970 PRINT FLP,
1990 PRINT FLP,TAB(Z1);'C11: EYES: ';
2010 GOTO 2030,2070 ON A(11)
2030 PRINT FLP,'SYMMETRICAL'
2050 GOTO 2090
2070 PRINT FLP,'ASYMMETRICAL'
2090 PRINT FLP,
```

```
2110 PRINT FLP,TAB(Z1);'C12: NOSE LENGTH: ';
2130 GOTO 2150,2190,2230 ON A(12)
2150 PRINT FLP,'LONG'
2170 GOTO 2250
2190 PRINT FLP,'NORMAL'
2210 GOTO 2250
2230 PRINT FLP,'SHORT'
2250 PRINT FLP,
2270 PRINT FLP,TAB(Z1);'C13: NOSE BEND: ';
2290 GOTO 2350,2310,2430,2390 ON A(13)
2310 PRINT FLP,'LIGHT LEFT'
2330 GOTO 2450
2350 PRINT FLP,'LIGHT RIGHT'
2370 GOTO 2450
2390 PRINT FLP,'ACUTE LEFT'
2410 GOTO 2450
2430 PRINT FLP,'ACUTE RIGHT'
2450 PRINT FLP,
2470 PRINT FLP,TAB(Z1);'C14: EAR RATIO: ';
2490 GOTO 2510,2550,2590 ON A(14)
2510 PRINT FLP,'LONG'
2530 GOTO 2610
2550 PRINT FLP,'NORMAL'
2570 GOTO 2610
2590 PRINT FLP,'SHORT'
2610 PRINT FLP,
2630 PRINT FLP,TAB(Z1);'C15: EAR SYMMETRY: ';
2650 GOTO 2670,2710 ON A(15)
2670 PRINT FLP,'SYMMETRICAL'
2690 GOTO 2730
2710 PRINT FLP,'ASYMMETRICAL'
2730 PRINT FLP,
2750 PRINT FLP,TAB(Z1);'C16: HAIR LINE: ';
2770 GOTO 2790,2830 ON A(16)
2790 PRINT FLP,'STRONG'
2810 GOTO 2850
2830 PRINT FLP,'WEAK'
2850 PRINT FLP,
2870 PRINT FLP,TAB(Z1);'C17: HAIR TEXTURE: ';
2890 GOTO 2910,2950,2990,3030,3070,3110,3150,3190,3230 ON A(17)
2910 PRINT FLP,'FINE AND CURLY'
2930 GOTO 3250
2950 PRINT FLP,'FINE AND STRAIGHT'
2970 GOTO 3250
2990 PRINT FLP,'FINE AND WAVY'
3010 GOTO 3250
3030 PRINT FLP,'MEDIUM AND CURLY'
3050 GOTO 3250
3070 PRINT FLP,'MEDIUM AND STRAIGHT'
3090 GOTO 3250
3110 PRINT FLP,'MEDIUM AND WAVY'
3130 GOTO 3250
3150 PRINT FLP,'COARSE AND CURLY'
3170 GOTO 3250
3190 PRINT FLP,'COARSE AND STRAIGHT'
3210 GOTO 3250
3230 PRINT FLP,'COARSE AND WAVY'
3250 PRINT FLP,
3270 PRINT FLP,TAB(Z1);'C18: GLASSES: ';
3290 GOTO 3310,3350 ON A(18)
3310 PRINT FLP,'WORN'
```

```
3330 GOTO 3351
3350 PRINT FLP,'NOT WORN'
3351 FOR X=1 TO 9
3352 PRINT FLP,
3353 NEXT X
3355 PRINT FLP,TAB(50)'(C) 1978 JACQUES BRODEUR'
3370 FOR X=1 TO 25
3390 PRINT FLP,
3410 NEXT X
3430 REM PRINT A INTRODUCTORY LETTER.
3450 X=6
3470 PRINT FLP,TAB(X)'BASED UPON HAIR AND FACIAL MEASURE';
3490 PRINT FLP,'MENTS TAKEN, THIS DATA HAS BEEN EVALUATED'
3510 PRINT FLP,TAB(X)'TO PROVIDE THE FOLLO';
3530 PRINT FLP,'WING SPECIFIC RECOMMENDATIONS FOR YOU, 'B$
3550 PRINT FLP,TAB(X)'THESE MEASUREMENTS HAVE BEEN INTERPRETED';
3570 PRINT FLP,' IN ACCORD WITH THE'
3590 PRINT FLP,TAB(X)'PRINCIPLES OF SYMMETRY ANALYSIS TO:'
3610 PRINT FLP,
3630 PRINT FLP,TAB(X+5)'*HIGHLIGHT YOUR MOST ATTRACTIVE ';
3650 PRINT FLP,'FEATURES'
3670 PRINT FLP,TAB(X+5)'*DEFINE HAIRCUT AND STYLE REQUIREMENTS';
3690 PRINT FLP,' FROM'
3710 PRINT FLP,TAB(X+6)'THE FRONT, PROFILE AND BACK VIEWS'
3730 PRINT FLP,TAB(X+5)'*DETERMINE WHERE THE VOLUME OF HAIR ';
3750 PRINT FLP,'MUST BE THE THICKEST'
3770 PRINT FLP,TAB(X+5)'*PROVIDE OPTIONS FOR MODIFYING YOUR ';
3790 PRINT FLP,'STYLE FOR CASUAL'
3810 PRINT FLP,TAB(X+6)'OR DRESSY EVENTS'
3830 PRINT FLP,TAB(X+5)'*HELP YOUR HAIR DESIGNER WORK WITHIN ';
3850 PRINT FLP,'THESE ESTABLISHED'
3870 PRINT FLP,TAB(X+6)'PRINCIPLES, SO THAT HE OR SHE CAN ';
3890 PRINT FLP,'MAKE THE MOST OF'
3910 PRINT FLP,TAB(X+6)'HIS OR HER ARTISTIC EXPERTISE'
3930 PRINT FLP,
3950 PRINT FLP,TAB(X)'WE TRUST YOU WILL BE PLEASED WITH THE ';
3970 PRINT FLP,'IMPORTANT KNOWLEDGE YOU'
3990 PRINT FLP,TAB(X)'NOW POSSESS - KNOWLEDGE THAT CAN BE ';
4010 PRINT FLP,'ADAPTED TO THE EVER-CHANGING'
4030 PRINT FLP,TAB(X)'WORLD OF HAIR FASHIONS, BUT WHOSE ';
4050 PRINT FLP,'TIMELESS QUALITIES WILL KEEP YOU'
4070 PRINT FLP,TAB(X)'ALWAYS LOOKING YOUR BEST.'
4071 FOR X=1 TO 9
4072 PRINT FLP,
4073 NEXT X
4074 PRINT FLP,TAB(50)'(C) 1978 JACQUES BRODEUR'
4090 FOR X=1 TO 21
4110 PRINT FLP,
4130 NEXT X
4150 CHAIN 'E80',4
0010 REM THIS IS THE FOURTH IN A SERIES OF SYMMETRY ANALYSIS
0020 REM PROGRAMS WRITTEN FOR BRODEUR INC.  THIS PROGRAM PRINTS
0030 REM THE CALCULATED CORRECT HAIR STYLE RECOMMENDATONS.
0040 REM DATE-WRITTEN. 04-17-78.
0050 REM PROGRAMMER. WALT BRUBAKER.
0060 USE A(25),A$,B$
0070 Q=8
0080 PRINT FLP,TAB(50);'(C) 1978 JACQUES BRODEUR'
0090 PRINT FLP,TAB(25)'SYMMETRY 2000 RECOMMENDS:'
0100 PRINT FLP,,,,,,,,,,,,,TAB(1)
0110 PRINT FLP,TAB(Q);'# 1: BACK VIEW'
0120 PRINT FLP,TAB(Q);'OBJECTIVE:  ';
```

```
0130 IF A(1)≠1|A(2)≠3 GOTO 0150
0140 GOTO 0570,0670,0620 ON A(3)
0150 IF A(1)≠1|A(2)≠1 GOTO 0170
0160 GOTO 0710,0780,0750 ON A(3)
0170 IF A(1)≠1|A(2)≠2 GOTO 0190
0180 GOTO 0820,0900,0860 ON A(3)
0190 IF A(1)≠2|A(2)≠3 GOTO 0210
0200 GOTO 0950,1030,0990 ON A(3)
0210 IF A(1)≠2|A(2)≠1 GOTO 0270
0220 IF A(3)=1 GOTO 1070
0230 IF A(3)=3&A(4)=1 GOTO 1110
0240 IF A(3)=3&A(4)=2 GOTO 1160
0250 IF A(3)=2&A(4)=1 GOTO 1180
0260 IF A(3)=2&A(4)=2 GOTO 1220
0270 IF A(1)≠2|A(2)≠2 GOTO 0330
0280 IF A(3)=1 GOTO 1260
0290 IF A(3)=3&A(4)=1 GOTO 1300
0300 IF A(3)=3&A(4)=2 GOTO 1340
0310 IF A(3)=2&A(4)=1 GOTO 1380
0320 IF A(3)=2&A(4)=2 GOTO 1430
0330 IF A(1)≠3|A(2)≠3 GOTO 0350
0340 GOTO 1480,1560,1520 ON A(3)
0350 IF A(1)≠3|A(2)≠1 GOTO 0410
0360 GOTO 1620,0370,0390 ON A(3)
0370 IF A(4)=1 GOTO 1660
0380 GOTO 1700
0390 IF A(4)=1 GOTO 1750
0400 GOTO 1790
0410 IF A(1)≠3|A(2)≠2 GOTO 0470
0420 GOTO 1830,0430,0450 ON A(3)
0430 IF A(4)=1 GOTO 1870
0440 GOTO 1910
0450 IF A(4)=1 GOTO 1950
0460 GOTO 2010
0470 PRINT FLP,TAB(Q)'(1-2-3-4-16-17)  SEE # 10.'
0475 PRINT FLP,,,,,,,,,TAB(1)
0480 PRINT FLP,TAB(Q);'# 2: FRONT VIEW'
0490 IF A(5)≠1 GOTO 0510
0500 GOTO 2040,2170,2250,2250,2320 ON A(6)
0510 IF A(5)≠2 GOTO 0530
0520 GOTO 2420,2500,2660,2660,2750 ON A(6)
0530 IF A(5)≠3 GOTO 0560
0540 GOTO 2840,2960,2960,3060,3150 ON A(6)
0550 PRINT FLP,TAB(Q)'(1-5-6-9 TO 15)  SEE # 4 TO 9.'
0555 PRINT FLP,,,,,TAB(1)
0560 CHAIN 'E80',5
0570 PRINT FLP,TAB(Q);'BUILD UP VOLUME FOR WIDTH. SHORTEN ';
0580 PRINT FLP,'THE NECK.'
0590 PRINT FLP,TAB(Q);'RECOMMENDATION:  SUGGESTED LENGTH 2 ';
0600 PRINT FLP,'OR 3 AND STRAIGHT ACROSS NECK LINE.'
0610 GOTO 0470
0620 PRINT FLP,TAB(Q);'BUILD UP VOLUME FOR WIDTH.  LENGTHEN ';
0630 PRINT FLP,'THE NECK.'
0640 PRINT FLP,TAB(Q);'RECOMMENDATION: LENGTH 2 OR 3 U ';
0650 PRINT FLP,'SHAPE NECK LINE.'
0660 GOTO 0470
0670 PRINT FLP,TAB(Q);'BUILD UP VOLUME FOR WIDTH.'
0680 PRINT FLP,TAB(Q);'RECOMMENDATION:  LENGTH 2 OR 3 STRAIGHT';
0690 PRINT FLP,'ACROSS NECK OR U SHAPE NECK LINE.'
0700 GOTO 0470
0710 PRINT FLP,TAB(Q);'NARROW DOWN SHOULDERS.  SHORTEN NECK.'
0720 PRINT FLP,TAB(Q);'RECOMMENDATION:  LENGTH 2, 3 OR 4 U ';
0730 PRINT FLP,'SHAPE NECK LINE.'
```

```
0740 GOTO 0470
0750 PRINT FLP,TAB(Q);'NARROW DOWN SHOULDERS.  SHORTEN NECK.'
0760 PRINT FLP,TAB(Q);'RECOMMENDATION:  3 OR 4 V SHAPE NECK LINE.'
0770 GOTO 0470
0780 PRINT FLP,TAB(Q);'NARROW DOWN SHOULDERS.'
0790 PRINT FLP,TAB(Q);'RECOMMENDATION:  LENGTH 3 OR 4 U ';
0800 PRINT FLP,'SHAPE NECK LINE OR V SHAPE NECK LINE.'
0810 GOTO 0470
0820 PRINT FLP,TAB(Q),'SHORTEN NECK.'
0830 PRINT FLP,TAB(Q);'RECOMMENDATION:  LENGTH 2 OR 3 ';
0840 PRINT FLP,'STRAIGHT ACROSS NECK LINE OR U SHAPE NECK LINE.'
0850 GOTO 0470
0860 PRINT FLP,TAB(Q);'ADD LENGTH TO NECK.'
0870 PRINT FLP,TAB(Q);'RECOMMENDATION:  LENGTH 2, 3 OR 4 U ';
0880 PRINT FLP,'SHAPE NECK LINE OR V SHAPE NECK LINE.'
0890 GOTO 0470
0900 PRINT FLP,TAB(Q);'MAINTAIN.'
0910 PRINT FLP,TAB(Q);'RECOMMENDATION:  LENGTH 2, 3 OR 4 ';
0920 PRINT FLP,'STRIGHT ACROSS NECK LINE, U '
0930 PRINT FLP,TAB(Q);' SHAPE NECK LINE OR V SHAPE NECK LINE.'
0940 GOTO 0470
0950 PRINT FLP,TAB(Q);'WIDEN SHOULDERS.  SHORTEN NECK.'
0960 PRINT FLP,TAB(Q);'RECOMMENDATION:  2, 3 STRAIGHT ';
0970 PRINT FLP,'ACROSS NECK LINE OR U SHAPE NECK LINE.'
0980 GOTO 0470
0990 PRINT FLP,TAB(Q);'WIDEN SHOULDERS.  LENGTHEN NECK.'
1000 PRINT FLP,TAB(Q);'RECOMMENDATION:  LENGTH 1 OR 2 ';
1010 PRINT FLP,'STRAIGHT LINE ACROSS NECK.'
1020 GOTO 0470
1030 PRINT FLP,TAB(Q);'WIDEN SHOULDERS.'
1040 PRINT FLP,TAB(Q);'RECOMMENDATION:  1, 2 STRAIGHT LINE ';
1050 PRINT FLP,'ACROSS NECK OR 3, 4 U SHAPE NECK LINE.'
1060 GOTO 0470
1070 PRINT FLP,TAB(Q);'NARROW SHOULDERS.  SHORTEN NECK.'
1080 PRINT FLP,TAB(Q);'RECOMMENDATIONS:  LENGTH 2, 3 OR ';
1090 PRINT FLP,'4 V SHAPE NECK LINE.'
1100 GOTO 0470
1110 PRINT FLP,TAB(Q);'NARROW SHOULDERS.  LENGTHEN NECK. ';
1120 PRINT FLP,' FILL IN BEHIND EARS.'
1130 PRINT FLP,TAB(Q);'RECOMMEDATIONS:  LENGTH 1 V SHAPE NECK ';
1140 PRINT FLP,'LINE OPEN.'
1150 GOTO 0470
1160 PRINT FLP,TAB(Q);'NARROW SHOULDERS. LENGTHEN NECK.'
1170 PRINT FLP,'NECK.'
1180 PRINT FLP,TAB(Q);'NARROW SHOULDERS.  FILL IN BEHIND EARS.'
1190 PRINT FLP,TAB(Q);'RECOMMENDATION:  LENGTH 2, 3 OR ';
1200 PRINT FLP,'4 V SHAPE NECK LINE OR U SHAPE NECK LINE.'
1210 GOTO 0470
1220 PRINT FLP,TAB(Q);'NARROW SHOULDERS.'
1230 PRINT FLP,TAB(Q);'RECOMMENDATIONS:  LENGTH   1-2-3-4 V ';
1240 PRINT FLP,'OR 1-2 U SHAPE NECK LINE.'
1250 GOTO 0470
1260 PRINT FLP,TAB(Q);'SHORTEN NECK.'
1270 PRINT FLP,TAB(Q);'RECOMMENDATION:  LENGTH 1 OR 2 ';
1280 PRINT FLP,'STRIGHT ACROSS NECK LINE.'
1290 GOTO 0470
1300 PRINT FLP,TAB(Q);'LENGTHEN NECK. FILL IN BEHIND EARS.'
1310 PRINT FLP,TAB(Q);'RECOMMENDATION:  LENGTH 1 V ';
1320 PRINT FLP,'SHAPE NECK LINE OPEN.'
1330 GOTO 0470
1340 PRINT FLP,TAB(Q);'LENGTHEN NECK.'
1350 PRINT FLP,TAB(Q);'RECOMMENDATIONS:  1-2 U OR 1-2-3-4 V ';
1360 PRINT FLP,'SHAPE NECK LINE.'
```

```
1370 GOTO 0470
1380 PRINT FLP,TAB(Q);'FILL IN BEHIND EARS.'
1390 PRINT FLP,TAB(Q);'RECOMMENDATION:  1 V SHAPE NECK ';
1400 PRINT FLP,'LINE OPEN OR 2, 3 OR 4 STRAIGHT '
1410 PRINT FLP,TAB(Q);'ACROSS NECK LINE; U OR V SHAPE NECK LINE.'
1420 GOTO 0470
1430 PRINT FLP,TAB(Q);'MAINTAIN.'
1440 PRINT FLP,TAB(Q);'RECOMMENDATIONS:  LENGTH 1-2 STRAIGHT ';
1450 PRINT FLP,'ACROSS NECK LINE OR 1-2-3-4 U'
1460 PRINT FLP,TAB(Q);'OR 1 TO 5 V SHAPE NECK LINE.'
1470 GOTO 0470
1480 PRINT FLP,TAB(Q);'SHORTEN NECK.  WIDEN SHOULDERS.'
1490 PRINT FLP,TAB(Q);'RECOMMENDATION:  LENGTH 2 STRAIGHT';
1500 PRINT FLP,' LINE ACROSS NECK OR U SHAPE NECK LINE.'
1510 GOTO 0470
1520 PRINT FLP,TAB(Q);'WIDEN SHOULDERS. LENGTHEN NECK.'
1530 PRINT FLP,TAB(Q);'RECOMMENDATION:  LENGTH 1 STRAIGHT LINE';
1540 PRINT FLP,'ACROSS NECK OR U SHAPE NECK LINE.'
1550 GOTO 0470
1560 PRINT FLP,TAB(Q);'WIDEN SHOULDERS.'
1570 PRINT FLP,TAB(Q);'RECOMMENDATION:  LENGHT 1 OR 2 ';
1580 PRINT FLP,'STRIGHT LINE ACROSS NECK OR U SHAPE'
1590 PRINT FLP,TAB(Q);' NECK LINE AND 3 U SHAPE OR V SHAPE ';
1600 PRINT FLP,'NECK LINE.'
1610 GOTO 0470
1620 PRINT FLP,TAB(Q);'NARROW SHOULDERS. SHORTEN NECK.'
1630 PRINT FLP,TAB(Q);'RECOMMENDATION:  LENGTH 2 V SHAPE ';
1640 PRINT FLP,'NECK LINE.'
1650 GOTO 0470
1660 PRINT FLP,'NARROW SHOULDERS. FILL IN BEHIND EARS.'
1670 PRINT FLP,TAB(Q);'RECOMMENDATION:  LENGTH 1 V SHAPE ';
1680 PRINT FLP,'NECK LINE OPEN.'
1690 GOTO 0470
1700 PRINT FLP,TAB(Q);'CREATE HEIGHT. NARROW SHOULDERS. '
1710 PRINT FLP,TAB(Q);'SHORTEN NECK.'
1720 PRINT FLP,TAB(Q);'RECOMMENDATIONS:  LENGTH 2 OR 3 V OR ';
1730 PRINT FLP,'2 U SHAPE NECK LINE.'
1740 GOTO 0470
1750 PRINT FLP,TAB(Q);'NARROW SHOULDERS.  FILL IN BEHIND EARS.'
1760 PRINT FLP,TAB(Q);'RECOMMANDATION:  LENGTH 1 V SHAPE ';
1770 PRINT FLP,'NECK LINE OPEN OR 2 V SHAPE NECK LINE.'
1780 GOTO 0470
1790 PRINT FLP,TAB(Q);'CREATE HEIGHT. NARROW SHOULDERS AND ';
1800 PRINT FLP,'LENGTHEN NECK.'
1810 PRINT FLP,TAB(Q);'RECOMMENDATIONS:  LENGTH 1-2 V SHAPE ';
1820 PRINT FLP,'NECK LINE.'
1830 PRINT FLP,TAB(Q);'SHORTEN NECK.'
1840 PRINT FLP,TAB(Q);'RECOMMENDATION:  LENGTH 2 STRAIGHT ';
1850 PRINT FLP,'LINE ACROSS NECK OR 2, 3 U SHAPE NECK LINE.'
1860 GOTO 0470
1870 PRINT FLP,TAB(Q);'LENGTHEN NECK.  FILL IN BEHIND EARS.'
1880 PRINT FLP,TAB(Q);'RECOMMENDATION:  1 V SHAPE NECK ';
1890 PRINT FLP,'LINE OPEN.'
1900 GOTO 0470
1910 PRINT FLP,TAB(Q);'CREATE HEIGHT.'
1920 PRINT FLP,TAB(Q);'RECOMMENDATIONS:  LENGTH 1 OR 2-3 V ';
1930 PRINT FLP,'OR 1 U SHAPE NECK LINE.'
1940 GOTO 0470
1950 PRINT FLP,TAB(Q);'OBJECTIVE:  FILL IN BEHIND EARS.'
1960 PRINT FLP,TAB(Q);'RECOMMENDATION:  1 V SHAPE NECK LINE ';
1970 PRINT FLP,'OR 2, 3  V SHAPE OR 1, 2, 3, 4'
1980 PRINT FLP,TAB(Q);'STRAIGHT ACROSS NECK LINE OR U SHAPE ';
1990 PRINT FLP,'NECK LINE.'
```

```
2000 GOTO 0470
2010 PRINT FLP,TAB(Q);'CREATE HEIGHT. LENGTHEN NECK.'
2020 PRINT FLP,TAB(Q);'RECOMMENDATIONS:  1-2 V SHAPE NECK LINE.'
2030 GOTO 0470
2040 PRINT FLP,TAB(Q);'LONG INVERTED TRIANGULAR FACE.'
2050 PRINT FLP,TAB(Q);'OBJECTIVE:  SHORTEN FACE.  BUILD ';
2060 PRINT FLP,'UP LOWER '
2070 PRINT FLP,TAB(Q);'HALF OF FACE.  NARROW THE FOREHEAD.'
2080 PRINT FLP,TAB(Q);'RECOMMENDATION:  NO SHORTER THAN ';
2090 PRINT FLP,'E2 WITH MAX. VOLUME BETWEEN'
2100 PRINT FLP,TAB(Q);'A2 TO F2.  SUGGESTED LENGTH FROM E2 ';
2110 PRINT FLP,'TO 2 OR 3 BACK USING CONCAVE NECKLINE.  ';
2120 PRINT FLP,'CENTER OR NEAR CENTER PART.'
2130 PRINT FLP,TAB(Q);'FILL IN R.  KEEP ABOVE A2 NARROW AND ';
2140 PRINT FLP,'NO VOLUME AT D.'
2150 PRINT FLP,TAB(Q);'SUGGESTED ONE LENGTH CUT.'
2160 GOTO 0550
2170 PRINT FLP,TAB(Q);'LONG OVAL FACE.'
2180 PRINT FLP,TAB(Q);'OBJECTIVE:  SHORTEN FACE.'
2190 PRINT FLP,TAB(Q);'RECOMMENDATION:  DISTRIBUTE VOLUME ';
2200 PRINT FLP,'EVENLY '
2210 PRINT FLP,TAB(Q);'FROM C2 TO E2.  FRONT LENGTH AT E2.  OFF'
2220 PRINT FLP,TAB(Q);'CENTER PART.  NO VOLUME AT D.  ';
2230 PRINT FLP,'LAYERED CUT.'
2240 GOTO 0550
2250 PRINT FLP,TAB(Q);'LONG RECTANGULAR FACE.'
2260 PRINT FLP,TAB(Q);'OBJECTIVE:  SHORTEN FACE.  NARROW ';
2270 PRINT FLP,'FOREHEAD AND THE JAW.'
2280 PRINT FLP,TAB(Q);'RECOMMENDATION:  MAXIMUM VOLUME AT '
2290 PRINT FLP,'A2. OFF CENTER PART.'
2300 PRINT FLP,TAB(Q);'SMALL VOLUME AT D.  NO VOLUME BELOW E2';
2305 PRINT FLP,' AND COVER -- R.'
2310 GOTO 0550
2320 PRINT FLP,TAB(Q);'LONG TRIANGULAR FACE.'
2330 PRINT FLP,TAB(Q);'OBJECTIVE:  SHORTEN FACE.  BUILD ';
2340 PRINT FLP,'UP UPPER HALF.'
2350 PRINT FLP,TAB(Q);'RECOMMENDATION:  MAXIMUM VOLUME ';
2360 PRINT FLP,'AT C2B2. NO '
2370 PRINT FLP,TAB(Q);'VOLUME AT D.  SIDE PARTS ONLY.  WIDE ';
2380 PRINT FLP,'BANGS ARE'
2390 PRINT FLP,TAB(Q);'GOOD.  NO LARGER THAN E2 AND NO ';
2400 PRINT FLP,'VOLUME AT ALL BELOW E2.'
2410 GOTO 0550
2420 PRINT FLP,TAB(Q);'INVERTED TRIANGULAR FACE.'
2430 PRINT FLP,TAB(Q);'OBJECTIVE:  NARROW FOREHEAD.  WIDEN ';
2440 PRINT FLP,'JAW LINE.'
2450 PRINT FLP,TAB(Q);'RECOMMENDATIONS:  SOME VOLUME AT D.';
2460 PRINT FLP,'  NO VOLUME AT C2 TO A2.  MAXIMUM'
2470 PRINT FLP,TAB(Q);'VOLUME AT E2 TO F2.  CENTER OR ';
2480 PRINT FLP,'NEAR CENTER.'
2490 GOTO 0550
2500 PRINT FLP,TAB(Q);'PERFECT OVAL FACE.'
2510 PRINT FLP,TAB(Q);'OBJECTIVE:  MAINTAIN IDEAL SHAPE FACE.'
2520 PRINT FLP,TAB(Q);'RECOMMENDATION:  KEEP VOLUME EVENLY ';
2530 PRINT FLP,'DISTRIBUTED AROUND FACE.'
2540 PRINT FLP,TAB(Q);'MINIMUM BANGS. PART ';
2550 PRINT FLP,'CENTER OR NEAR.  KEEP HAIR AWAY FROM FACE'
2560 GOTO 0550
2570 PRINT FLP,TAB(Q);'MAXIMUM VOLUME BETWEEN A2 TO F2. ';
2580 PRINT FLP,'SUGGESTED '
2590 PRINT FLP,TAB(Q);'LENGTH FROM E2 TO 2 OR 3 BACK USING';
2600 PRINT FLP,' CONCAVE '
```

```
2610 PRINT FLP,TAB(Q);'NECK LINE.  PART AT CENTER OR NEAR.  ';
2620 PRINT FLP,'FILL IN R.'
2630 PRINT FLP,TAB(Q);'KEEP ABOVE A2 NARROW AND NO VOLUME ';
2640 PRINT FLP,'AT D. OR LENGTH CUT.'
2650 GOTO 0550
2660 PRINT FLP,TAB(Q);' RECTANGULAR FACE.'
2670 PRINT FLP,TAB(Q);'OBJECTIVE:  REDUCE WIDTH AT FOREHEAD ';
2680 PRINT FLP,'AND JAW LINE.'
2690 PRINT FLP,TAB(Q);'RECOMMENDATION:  MAXIMUM VOLUME AT ';
2700 PRINT FLP,'A2.  SOME '
2710 PRINT FLP,TAB(Q);'VOLUME AT D.  CENTER OR NEAR CENTER ';
2720 PRINT FLP,'PART. COVER AT R.  NO VOLUME BELOW A2.'
2730 PRINT FLP,TAB(Q);'CUT:  SHORTEN TOP.  SHORT RADIAL.'
2740 GOTO 0550
2750 PRINT FLP,TAB(Q);'TRIANGULAR FACE.'
2760 PRINT FLP,TAB(Q);'OBJECTIVE:  BUILD UP UPPER FACE AND ';
2770 PRINT FLP,'NARROW JAW LINE.'
2780 PRINT FLP,TAB(Q);'RECOMMENDATION:  MAXIMUM VOLUME AT C2B2.'
2790 PRINT FLP,TAB(Q);'VOLUME AT D.  NO VOLUME BELOW E2.  ';
2800 PRINT FLP,'FULL ACROSS BANGS OR SIDE PART.'
2810 PRINT FLP,TAB(Q);'CUT:  SHORT LAYERED TOP.  SHORT ';
2820 PRINT FLP,'SIDES TO A2 OR E2.'
2830 GOTO 0550
2840 PRINT FLP,TAB(Q);'SHORT INVERTED TRIANGULAR FACE.'
2850 PRINT FLP,TAB(Q);'OBJECTIVE:  LENGTHEN FACE.  BUILD ';
2860 PRINT FLP,'UP BOTTOM '
2870 PRINT FLP,TAB(Q);'HALF OF FACE AND NARROW THE UPPER HALF '
2880 PRINT FLP,TAB(Q);'RECOMMENDATION:  LIFT BANGS UP AT ';
2890 PRINT FLP,'CENTER OF '
2900 PRINT FLP,TAB(Q);'FOREHEAD.  COVER AT RS.  VOLUME AT D.';
2910 PRINT FLP,'  MAXIMUM'
2920 PRINT FLP,TAB(Q);'VOLUME AT A2 TO F2.  NO VOLUME AT ';
2930 PRINT FLP,'ALL AT C2B2.'
2940 PRINT FLP,TAB(Q);'CUT:  LAYER BACK #2 OR #3.  EXPANSION.'
2950 GOTO 0550
2960 PRINT FLP,TAB(Q);'ROUND FACE.'
2970 PRINT FLP,TAB(Q);'OBJECTIVE:  NARROW DOWN AT CHEEK BONE.';
2980 PRINT FLP,'  LENGTHEN FACE.'
2990 PRINT FLP,TAB(Q);'RECOMMENDATION:  VOLUME AT D, C2 AND B2. '
3000 PRINT FLP,TAB(Q);'CLOSE IN AT A2.  LIFT BACK CENTER ';
3010 PRINT FLP,'OF BANGS.  '
3020 PRINT FLP,TAB(Q);'MOVE HAIR AWAY FROM FACE AT C2B2.'
3030 PRINT FLP,TAB(Q);'CUT:  E2 OR LONGER. PART CENTER OR ';
3040 PRINT FLP,'NEAR CENTER.'
3050 GOTO 0550
3060 PRINT FLP,TAB(Q);'SQUARE FACE.'
3070 PRINT FLP,TAB(Q);'OBJECTIVE:  LENGTHEN FACE. NARROW DOWN ';
3080 PRINT FLP,'FOREHEAD AND JAWS.'
3090 PRINT FLP,TAB(Q);'RECOMMENDATION:  VOLUME AT D.  PART NEAR'
3100 PRINT FLP,TAB(Q);'CENTER OR CENTER.  COVER AT RS.  VOLUME';
3110 PRINT FLP,' AT C2.'
3120 PRINT FLP,TAB(Q);'CLOSE IN AT A2.  NO VOLUME BELOW A2.'
3130 PRINT FLP,TAB(Q);'CUT:  LAYERED TOP.'
3140 GOTO 0550
3150 PRINT FLP,TAB(Q);'SHORT TRIANGULAR FACE.'
3160 PRINT FLP,TAB(Q);'OBJECTIVE:  LENGTHEN FACE AND NARROW ';
3170 PRINT FLP,' DOWN '
3180 PRINT FLP,TAB(Q);'LOWER HALF AND BUILD UP UPPER HALF.'
3190 PRINT FLP,TAB(Q);'RECOMMENDATION:  VOLUME AT D, C2, ';
3200 PRINT FLP,'B2. LENGTH '
3210 PRINT FLP,TAB(Q);'AT A2. NO VOLUME BELOW A2. SIDE PART ';
3220 PRINT FLP,'WITH LIFT.'
```

```
3230 GOTO 0550
3240 FOR X=1 TO 15
3250 PRINT
3260 NEXT X
3270 RETURN
3280 GOSUB 3240
3290 PRINT '*********************************************'
3300 PRINT '*************| ERROR, TRY AGAIN |*************'
3310 PRINT '*********************************************'
3320 PRINT
3330 RETURN
0010 REM THIS IS THE FIFTH IN A SERIES OF SYMMETRY ANALYSIS
0020 REM PROGRAMS WRITTEN FOR BRODEUR INC.  THIS PROGRAM PRINTS
0030 REM THE CALCULATED CORRECT HAIR STYLE RECOMMENDATONS.
0040 REM DATE-WRITTEN. 04-19-78.
0050 REM PROGRAMMER. WALT BRUBAKER.
0060 USE A(25),A$,B$
0065 Z1=8
0066 PRINT FLP,TAB(Z1);'# 3: PROFILE VIEW'
0070 PRINT FLP,TAB(Z1);'OBJECTIVE:  ';
0080 IF A(7)≠2|A(8)≠2 GOTO 0100
0090 GOTO 2000,2100,2200 ON A(9)
0100 IF A(7)≠2|A(8)≠1 GOTO 0120
0110 GOTO 2300,2400,2500 ON A(9)
0120 IF A(7)≠2|A(8)≠3 GOTO 0140
0130 GOTO 2600,2700,2800 ON A(9)
0140 IF A(7)≠1|A(8)≠2 GOTO 0160
0150 GOTO 2900,3000,3100 ON A(9)
0160 IF A(7)≠1|A(8)≠1 GOTO 0180
0170 GOTO 3200,3300,3400 ON A(9)
0180 IF A(7)≠1|A(8)≠3 GOTO 0200
0190 GOTO 3500,3600,3700 ON A(9)
0200 IF A(7)≠3|A(8)≠2 GOTO 0220
0210 GOTO 3800,3900,4000 ON A(9)
0220 IF A(7)≠3|A(8)≠1 GOTO 0240
0230 GOTO 4100,4200,4300 ON A(9)
0240 IF A(7)≠3|A(8)≠3 GOTO 0260
0250 GOTO 4400,4500,4600 ON A(9)
0260 PRINT 'ERROR, PROFILE TYPE NOT FOUND ←←←←←←←←←←←←←←←←←'
0300 PRINT FLP,TAB(Z1)'(7-8)  SEE # 6.'
0310 CHAIN 'E80',6
1990 REM THIS SECTION PRINTS THE RECOMMENDATIONS FOR PROFILE.
2000 PRINT FLP,TAB(Z1);'MAINTAIN PROPER BALANCE.'
2010 PRINT FLP,TAB(Z1);'RECOMMENDATION:  EVEN DISTRIBUTION ';
2011 PRINT FLP,'FROM E TO B.'
2020 GOTO 0300
2100 PRINT FLP,TAB(Z1);'MAINTAIN BALANCE AND BUILD UP AT E.'
2110 PRINT FLP,TAB(Z1);'RECOMMENDATION:  VOLUME AT E. EVEN ';
2120 PRINT FLP,'DISTRIBUTION FROM D TO B.'
2130 GOTO 0300
2200 PRINT FLP,TAB(Z1);'ELIMINATE VOLUME OF FOREHEAD.'
2210 PRINT FLP,TAB(Z1);'RECOMMENDATION:  SOME VOLUME AT ';
2211 PRINT FLP,'C AND D.'
2220 GOTO 0300
2300 PRINT FLP,TAB(Z1);'SHORTEN DIAGONAL LINE.'
2310 PRINT FLP,TAB(Z1);'RECOMMENDATION:  VOLUME AT B AND A.'
2320 GOTO 0300
2400 PRINT FLP,TAB(Z1);'SHORTEN DIAGONAL LINE AND BUILD UP ';
2401 PRINT FLP,'FOREHEAD.'
2410 PRINT FLP,TAB(Z1);'RECOMMENDATION:  VOLUME AT B AND A AND ';
2420 PRINT FLP,'VOLUME AT E.'
2430 GOTO 0300
2500 PRINT FLP,TAB(Z1);'SHORTEN DIAGONAL AND ELIMINATE ';
```

```
2510 PRINT FLP,'VOLUME AT FOREHEAD.'
2520 PRINT FLP,TAB(Z1);'RECOMMENDATION:  VOLUME AT B AND A.';
2530 PRINT FLP,'  SOME VOLUME BETWEEN E AND D.'
2540 GOTO 0300
2600 PRINT FLP,TAB(Z1);'ADD LENGTH TO DIAGONAL.'
2610 PRINT FLP,TAB(Z1);'RECOMMENDATION:  VOLUME AT C AND D.'
2620 GOTO 0300
2700 PRINT FLP,TAB(Z1);'BUILD UP FOREHEAD AND ADD LENGTH TO ';
2701 PRINT FLP,'DIAGONAL.'
2710 PRINT FLP,TAB(Z1);'RECOMMENDATION:  VOLUME AT E, C AND D.'
2720 GOTO 0300
2800 PRINT FLP,TAB(Z1);'ELIMINATE VOLUME AT FOREHEAD.  ';
2810 PRINT FLP,'ADD LENGTH TO DIAGONAL.'
2820 PRINT FLP,TAB(Z1);'RECOMMENDATION:  VOLUME AT C ';
2830 PRINT FLP,'AND D AND BETWEEN E AND D.'
2840 GOTO 0300
2900 PRINT FLP,TAB(Z1);'SHORTEN HORIZONTAL LINE.'
2910 PRINT FLP,TAB(Z1);'RECOMMENDATION:  VOLUME AT D.'
2920 GOTO 0300
3000 PRINT FLP,TAB(Z1);'SHORTEN THE HORIZONTAL LINE AND BUILD';
3010 PRINT FLP,' UP THE FOREHEAD.'
3020 PRINT FLP,TAB(Z1);'RECOMMENDATION:  MAXIMUM VOLUME AT'
3030 PRINT FLP,' C AND SOME VOLUME AT E.'
3040 GOTO 0300
3100 PRINT FLP,TAB(Z1);'SHORTEN HORIZONTAL LINE AND SOFTEN';
3101 PRINT FLP,' FOREHEAD.'
3110 PRINT FLP,TAB(Z1);'RECOMMENDATION:  MAXIMUM VOLUME AT ';
3120 PRINT FLP,' C AND SOME VOLUME AT D.'
3130 GOTO 0300
3200 PRINT FLP,TAB(Z1);'SOFTEN HORIZONTAL AND DIAGONAL LINE.'
3210 PRINT FLP,TAB(Z1);'RECOMMENDATION:  LINES TEND TO ';
3211 PRINT FLP,'COUNTERBALANCE '
3220 PRINT FLP,TAB(Z1);'EACH OTHER.  SOME VOLUME AT D AND E.'
3230 GOTO 0300
3300 PRINT FLP,TAB(Z1);'SHORTEN HORIZONTAL AND DIAGONAL ';
3310 PRINT FLP,'LINES AND BUILD UP FACE.'
3320 PRINT FLP,TAB(Z1);'RECOMMENDATION:  LINES TEND TO ';
3321 PRINT FLP,'COUNTERBALANCE '
3330 PRINT FLP,TAB(Z1);'EACH OTHER.  SOME VOLUME AT D AND E.'
3340 GOTO 0300
3400 PRINT FLP,TAB(Z1);'SHORTEN HORIZONTAL AND DIAGONAL LINES';
3410 PRINT FLP,' AND SOFTEN FOREHEAD.'
3420 PRINT FLP,TAB(Z1);'RECOMMENDATION:  SOME VOLUME AT E.'
3430 GOTO 0300
3500 PRINT FLP,TAB(Z1);'SHORTEN HORIZONTAL LINE, LENGTHEN ';
3501 PRINT FLP,'DIAGONAL LINE.'
3510 PRINT FLP,TAB(Z1);'RECOMMENDATION:  VOLUME AT C AND ';
3511 PRINT FLP,'SOME AT D.'
3520 GOTO 0300
3600 PRINT FLP,TAB(Z1);'SHORTEN HORIZONTAL LINE.  LENGTHEN ';
3610 PRINT FLP,'DIAGONAL LINE.  BUILD UP FOREHEAD.'
3620 PRINT FLP,TAB(Z1);'RECOMMENDATION:  VOLUME AT C AND E.'
3630 GOTO 0300
3700 PRINT FLP,TAB(Z1);'SHORTEN HORIZONTAL LINE.  LENGTHEN ';
3710 PRINT FLP,'DIAGONAL LINE.  SOFTEN FOREHEAD.'
3720 PRINT FLP,TAB(Z1);'RECOMMENDATION:  VOLUME AT C AND SOME ';
3730 PRINT FLP,'VOLUME AT D.'
3740 GOTO 0300
3800 PRINT FLP,TAB(Z1);'LENGTHEN HORIZONTAL LINE.'
3810 PRINT FLP,TAB(Z1);'RECOMMENDATION:  VOLUME AT B  ';
3811 PRINT FLP,'(LAYERED CUT)'
3820 GOTO 0300
3900 PRINT FLP,TAB(Z1);'LENGTHEN HORIZONTAL LINE.  BUILD UP ';
```

```
3901 PRINT FLP,' FOREHEAD.'
3910 PRINT FLP,TAB(Z1);'RECOMMENDATION:  VOLUME AT B AND E ';
3911 PRINT FLP,'(LAYERED CUT)'
3920 GOTO 0300
4000 PRINT FLP,TAB(Z1);'LENGTHEN HORIZONTAL LINE.  SOFTEN ':
4001 PRINT FLP,'FOREHEAD.'
4010 PRINT FLP,TAB(Z1);'RECOMMENDATION:  VOLUME AT B.  SOME ',
4020 PRINT FLP,'VOLUME  AT D.  (LAYERED CUT).'
4030 GOTO 0300
4100 PRINT FLP,TAB(Z1);'LENGTHEN HORIZONTAL.  SHORTEN DIAGONAL.'
4110 PRINT FLP,TAB(Z1);'RECOMMENDATION:  MAXIMUM VOLUME AT B.'
4120 GOTO 0300
4200 PRINT FLP,TAB(Z1);'LENGTHEN HORIZONTAL.  SHORTEN DIAGONAL';
4210 PRINT FLP,'.   BUILD UP FOREHEAD.'
4220 PRINT FLP,TAB(Z1);'RECOMMENDATION:  MAXIMUM VOLUME AT B. ';
4230 PRINT FLP,' SOME VOLUME AT E.'
4240 GOTO 0300
4300 PRINT FLP,TAB(Z1);'LENGTHEN HORIZONTAL.  SHORTEN DIAGONAL';
4310 PRINT FLP,'.   SOFTEN FOREHEAD.'
4320 PRINT FLP,TAB(Z1);'RECOMMENDATION:  MAXIMUM VOLUME AT B.'
4330 GOTO 0300
4400 PRINT FLP,TAB(Z1);'HEAD APPEARS TOO SMALL.  LENGTHEN ';
4410 PRINT FLP,'HORZONTAL AND DIAGONAL.'
4420 PRINT FLP,TAB(Z1);'RECOMMENDATION:  BUILD UP VOLUME ';
4430 PRINT FLP,'FORM D TO B.  (LAYERED CUT).'
4440 GOTO 0300
4500 PRINT FLP,TAB(Z1);' HEAD APPEARS TOO SMALL.  BUILD UP ';
4501 PRINT FLP,'FOREHEAD. '
4510 PRINT FLP,TAB(Z1);' LENGTHEN HORIZONTAL AND DIAGONAL.'
4520 PRINT FLP,TAB(Z1);'RECOMMENDATION:  BUILD UP VOLUME ';
4530 PRINT FLP,'FROM E TO B.  (LAYERED CUT).'
4540 GOTO 0300
4600 PRINT FLP,TAB(Z1);'HEAD APPEARS TOO SMALL.  LENGTHEN ';
4610 PRINT FLP,'HORIZONTAL AND DIAGONAL.'
4620 PRINT FLP,TAB(Z1);'RECOMMENDATION:  BUILD UP VOLUME ';
4630 PRINT FLP,'FROM E TO B.  (LAYERED CUT).'
4640 GOTO 0300
9000 FOR X=1 TO 15
9010 PRINT
9020 NEXT X
9030 RETURN
9500 GOSUB 9000
9510 PRINT '*****************************************************'
9520 PRINT '************| ERROR, TRY AGAIN |*************'
9530 PRINT '*****************************************************'
9540 PRINT
9550 RETURN
0010 REM THIS IS THE SIXTH IN A SERIES OF SYMMETRY ANALYSIS
0020 REM PROGRAMS WRITTEN FOR BRODEUR INC.  THIS PROGRAM PRINTS
0030 REM THE CALCULATED CORRECT HAIR STYLE RECOMMENDATONS.
0040 REM DATE-WRITTEN. 04-21-78.
0050 REM PROGRAMMER. WALT BRUBAKER.
0060 USE A(25),A$,B$
0070 Z1=8
0075 PRINT FLP,,,,,,,,TAB(1)
0080 PRINT FLP,TAB(Z1);'# 4: EYE SPAN'
0090 GOTO 0460,0530,0600 ON A(10)
0100 PRINT FLP,,,,,,,,TAB(1)
0110 PRINT FLP,TAB(Z1);'# 5: EYE SYMMETRY'
0120 GOTO 0650,0700 ON A(11)
0130 FOR X=1 TO 30
0140 PRINT FLP,
```

```
0150 NEXT X
0160 PRINT FLP,TAB(25)'SYMMETRY 2000 RECOMMENDS:'
0170 PRINT FLP,,,,,,,,,,,,,TAB(1)
0180 PRINT FLP,TAB(Z1);'# 6: NOSE LENGTH'
0190 GOTO 0770,0840,0880 ON A(12)
0200 PRINT FLP,,,,,,,,,TAB(1)
0210 PRINT FLP,TAB(Z1);'# 7: NOSE BEND'
0220 PRINT FLP,TAB(Z1);'OBJECTIVE:  ';
0230 GOTO 1020,0960,1160,1090 ON A(13)
0240 PRINT FLP,,,,,,,,,TAB(1)
0250 PRINT FLP,TAB(Z1);'# 8: EARS LENGTH'
0260 PRINT FLP,TAB(Z1);'OBJECTIVE:  ';
0270 GOTO 1230,1280,1340 ON A(14)
0280 PRINT FLP,,,,,,,,,TAB(1)
0290 PRINT FLP,TAB(Z1);'# 9: EAR SYMMETRY'
0300 PRINT FLP,TAB(Z1);'OBJECTIVE:  ';
0310 GOTO 1390,1440 ON A(15)
0320 PRINT FLP,,,,,,,,,TAB(1)
0330 PRINT FLP,TAB(Z1);'#10: HAIR LINE'
0340 GOTO 1520,1590 ON A(16)
0350 PRINT FLP,,,,,,,,,TAB(1)
0360 PRINT FLP,TAB(Z1);'#11: HAIR TEXTURE AND TYPE'
0370 GOTO 1650,1780,1880,1980,2090,2160,2230,2320,2410 ON A(17)
0380 PRINT FLP,,,,,,,,,TAB(1)
0390 IF A(18)=2 GOTO 0450
0400 PRINT FLP,TAB(Z1);'#12: GLASSES'
0410 GOTO 2480,2510,0420,0420,2620 ON A(6)
0420 IF A(5)≠3 GOTO 2680
0430 IF A(6)=3 GOTO 2540
0440 GOTO 2580
0450 CHAIN 'E80',7
0460 REM THIS SECTION PRINTS RECOMMENDATIONS FOR MISC. INPUT.
0470 PRINT FLP,TAB(Z1);'OBJECTIVE:  SHORTEN SPAN.'
0480 PRINT FLP,TAB(Z1);'RECOMMENDATION:  USE CENTER PART OR VERY '
0490 PRINT FLP,TAB(Z1);'NEAR.  LESS VOLUME AT THE EYE LEVEL. ';
0500 PRINT FLP,' FACIAL '
0510 PRINT FLP,TAB(Z1);'SYMMETRY RECOMMENDATION HAS PRIORITY.'
0520 GOTO 0100
0530 PRINT FLP,TAB(Z1);'OBJECTIVE:  WIDEN SPAN.'
0540 PRINT FLP,TAB(Z1);'RECOMMENDATION:  COMB AWAY FROM FACE ';
0550 PRINT FLP,'ON SIDES.'
0560 PRINT FLP,TAB(Z1);'MORE VOLUME AT EYE LEVEL.  FACIAL ';
0570 PRINT FLP,'SYMMETRY ';
0580 PRINT FLP,'RECOMMENDATION HAS PRIORITY.'
0590 GOTO 0100
0600 PRINT FLP,TAB(Z1);'OBJECTIVE:  MAINTAIN.'
0610 PRINT FLP,TAB(Z1);'RECOMMENDATION:  EYE SPAN IS IN GOOD ';
0620 PRINT FLP,'PROPORTION'
0630 PRINT FLP,TAB(Z1);'THEREFORE DOES NOT AFFECT YOUR STYLE.'
0640 GOTO 0100
0650 PRINT FLP,TAB(Z1);'OBJECTIVE:  MAINTAIN.'
0660 PRINT FLP,TAB(Z1);'RECOMMENDATION:  EYES ARE SYMMETRICAL';
0670 PRINT FLP,' THERF';
0680 PRINT FLP,'ORE DO NOT AFFECT YOUR STYLES.'
0690 GOTO 0130
0700 PRINT FLP,TAB(Z1);'OBJECTIVE:  MAINTAIN.'
0710 PRINT FLP,TAB(Z1);'RECOMMENDATION:  YOUR EYES ARE NOT ';
0720 PRINT FLP,'EVEN AND '
0730 PRINT FLP,TAB(Z1);'THEREFORE RECOMMEND TO DIRECT HAIR AND ';
0740 PRINT FLP,'VOLUME '
0750 PRINT FLP,TAB(Z1);'TOWARD LOWER EYE FORWARD ONTO FOREHEAD.'
0760 GOTO 0130
0770 PRINT FLP,TAB(Z1);'OBJECTIVE:  PLAY DOWN NOSE.'
```

```
0780 PRINT FLP,TAB(Z1);'RECOMMENDATION:  SOME VOLUME AT F.  ';
0790 PRINT FLP,'SOFT FOR'
0800 PRINT FLP,TAB(Z1);'WARD MOVEMENT BUT DO NOT BRING HAIR ';
0810 PRINT FLP,'INTO FACE.'
0820 PRINT FLP,TAB(Z1);'USE RECOMMENDATIONS ON PROFILE OUTPUT.'
0830 GOTO 0200
0840 PRINT FLP,TAB(Z1);'OBJECTIVE:  MAINTAIN.'
0850 PRINT FLP,TAB(Z1);'RECOMMENDATION: YOUR NOSE IS WELL ';
0860 PRINT FLP,'PROPORTIONED.'
0870 GOTO 0200
0880 PRINT FLP,TAB(Z1);'OBJECTIVE:  MAINTAIN.'
0890 PRINT FLP,TAB(Z1);'RECOMMENDATION:  YOUR NOSE IS SHORT IN';
0900 PRINT FLP,' PROPOR-'
0910 PRINT FLP,TAB(Z1);'TION TO THE FACE BUT IS NOT A HANDICAP. '
0920 PRINT FLP,TAB(Z1);'PROFILE MAY APPEAR NARROWER.  FOLLOW ';
0930 PRINT FLP,'RECOMMEND';
0940 PRINT FLP,'ATIONS FOR PROFILE SYMMETRY.'
0950 GOTO 0200
0960 PRINT FLP,TAB(Z1);'SOFTEN BEND.'
0970 PRINT FLP,TAB(Z1);'RECOMMENDATION:  NOSE IS SLIGHTLY BENT';
0980 PRINT FLP,' TO THE '
0990 PRINT FLP,TAB(Z1);'LEFT.  MOVE FLOW OF THE STYLE TO THE';
1000 PRINT FLP,' RIGHT.'
1010 GOTO 0240
1020 PRINT FLP,TAB(Z1);'SOFTEN BEND.'
1030 PRINT FLP,TAB(Z1);'RECOMMENDATION:  NOSE IS SLIGHTLY BENT';
1040 PRINT FLP,' TO THE '
1050 PRINT FLP,TAB(Z1);'RIGHT.  MOVE FLOW OF STYLE TO THE';
1060 PRINT FLP,' LEFT TO ';
1070 PRINT FLP,'COUNTERACT.'
1080 GOTO 0240
1090 PRINT FLP,TAB(Z1);'SOFTEN BEND.'
1100 PRINT FLP,TAB(Z1);'RECOMMENDATION:  NOSE IS EXTREMELY BENT';
1110 PRINT FLP,' TO THE'
1120 PRINT FLP,TAB(Z1);'LEFT.  MOVE HAIR FLOW MOVEMENT IN';
1130 PRINT FLP,' THE SAME';
1140 PRINT FLP,' DIRECTION--TO THE LEFT.'
1150 GOTO 0240
1160 PRINT FLP,TAB(Z1);'SOFTEN BEND.'
1170 PRINT FLP,TAB(Z1);'RECOMMENDATION:  NOSE IS EXTREMELY BENT';
1180 PRINT FLP,' TO THE'
1190 PRINT FLP,TAB(Z1);'RIGHT.  MOVE HAIR FLOW MOVEMENT IN';
1200 PRINT FLP,' THE SAME';
1210 PRINT FLP,' DIRECTION--TO THE RIGHT.'
1220 GOTO 0240
1230 PRINT FLP,TAB(Z1);'SHORTEN EAR.'
1240 PRINT FLP,TAB(Z1);'RECOMMENDATION:  EARS ARE TOO LONG. ';
1250 PRINT FLP,' SHOULD ';
1260 PRINT FLP,'BE PARTIALLY HIDDEN.'
1270 GOTO 0280
1280 PRINT FLP,'MAINTAIN.'
1290 PRINT FLP,TAB(Z1);'EARS ARE WELL PROPORTIONED AND MAY BE';
1300 PRINT FLP,' COMPLETE'
1310 PRINT FLP,TAB(Z1);'LY EXPOSED.  (SECONDARY TO OTHER ';
1320 PRINT FLP,'SYMMETRY)'
1330 GOTO 0280
1340 PRINT FLP,'MAINTAIN.'
1350 PRINT FLP,TAB(Z1);'RECOMMENDATION:  EARS ARE SHORT BUT ';
1360 PRINT FLP,'DO NOT '
1370 PRINT FLP,TAB(Z1);'HANDICAP STYLE.  THEY MAY BE EXPOSED.'
1380 GOTO 0280
1390 PRINT FLP,'MAINTAIN.'
```

```
1400 PRINT FLP,TAB(Z1);'RECOMMENDATION:  YOUR EARS ARE EVEN ';
1410 PRINT FLP,'AND WILL ';
1420 PRINT FLP,'NOT HANDICAP THE CUT.'
1430 GOTO 0320
1440 PRINT FLP,'BE ALERT.'
1450 PRINT FLP,TAB(Z1);'RECOMMENDATION:  BE AWARE THAT EARS ';
1460 PRINT FLP,' ARE NOT '
1470 PRINT FLP,TAB(Z1);'EVEN.  WHILE CUTTING BASE LINES MAKE';
1480 PRINT FLP,' ALLOWANCES'
1490 PRINT FLP,TAB(Z1);'IN ORDER TO KEEP THE CUT SYMMETRICAL';
1500 PRINT FLP,' LOOKING.'
1510 GOTO 0320
1520 PRINT FLP,TAB(Z1);'YOU ARE LUCKY TO HAVE A STRONG ';
1530 PRINT FLP, HAIRLINE.  THIS'
1540 PRINT FLP,TAB(Z1);' MAKES IT POSSIBLE TO HAVE MORE VOLUME';
1550 PRINT FLP,' AROUND'
1560 PRINT FLP,TAB(Z1);'FACE AND YOU CAN ENJOY VERY SHORT ';
1570 PRINT FLP,'NECK LINES.'
1580 GOTO 0350
1590 PRINT FLP,TAB(Z1);'YOUR HAIRLINE IS WEAK THEREFORE FULLER';
1600 PRINT FLP,' AND A '
1610 PRINT FLP,TAB(Z1);'THICKER BASE LINE IS NECESSARY.  DO ';
1620 PRINT FLP,'NOT OVER';
1630 PRINT FLP,'TAPER SIDES AND NECKLINE.'
1640 GOTO 0350
1650 PRINT FLP,TAB(Z1);'FINE AND CURLY HAIR IS VERY DELICATE.';
1660 PRINT FLP,'  HANDLE '
1670 PRINT FLP,TAB(Z1);'WITH CARE AND WATCH FOR OVER ELASTICITY';
1680 PRINT FLP,'.  IT'
1690 PRINT FLP,TAB(Z1);'WILL PERFORM BETTER IF SHORT.  CURLING';
1700 PRINT FLP,' CAN BE '
1710 PRINT FLP,TAB(Z1);'STRAIGHTENED EASILY WITH BLOW DRYERS OR';
1720 PRINT FLP,' ROLLERS.'
1730 PRINT FLP,TAB(Z1);'BECAUSE CURL MAY TEND TO BE BRITTLE, ';
1740 PRINT FLP,'MOISTURE IS OFTEN NEEDED.'
1750 PRINT FLP,TAB(Z1);'BECAUSE IT COLLAPSES EASILY IT MAY ';
1760 PRINT FLP,'HAVE TO BE REDONE DAILY.'
1770 GOTO 0380
1780 PRINT FLP,TAB(Z1);'HANDLE WITH CARE AND WATCH FOR OVER ';
1790 PRINT FLP,'ELASTICITY';
1800 PRINT FLP,'.  IT PERFORMS BETTER'
1810 PRINT FLP,TAB(Z1);'IN A SHORTER LENGTH.  ';
1820 PRINT FLP,'PERMANENT AND HAIR COLORING IS SUGGESTED';
1830 PRINT FLP,' FOR '
1840 PRINT FLP,TAB(Z1);'ADDITIONAL BODY.  COLLAPSES EASILY AND ';
1850 PRINT FLP,'MAY HAVE';
1860 PRINT FLP,' TO BE REDONE DAILY.'
1870 GOTO 0380
1880 PRINT FLP,TAB(Z1);'HANDLE WITH CARE AND WATCH FOR OVER ';
1890 PRINT FLP,'ELASTICITY'
1900 PRINT FLP,TAB(Z1);'.  IT PERFORMS BETTER IN A SHORTER ';
1910 PRINT FLP,'LENGTH.'
1920 PRINT FLP,TAB(Z1);'PERMANENT AND HAIR COLORING IS SUGGESTED';
1930 PRINT FLP,' FOR '
1940 PRINT FLP,TAB(Z1);'ADDITIONAL BODY.  FINE HAIR COLLAPSES';
1950 PRINT FLP,' EASILY'
1960 PRINT FLP,TAB(Z1);'AND MAY HAVE TO BE REDONE DAILY.'
1970 GOTO 0380
1980 PRINT FLP,TAB(Z1);'HAIR IS STRONG, WILL RESPOND WELL TO';
1990 PRINT FLP,' NATURAL '
2000 PRINT FLP,TAB(Z1);'DRYING.  IT HAS A LOT OF BODY AND WILL'
2010 PRINT FLP,' REQUIRE'
2020 PRINT FLP,TAB(Z1);'MORE SKILL TO BLOW DRY STRAIGHT.  USE ';
2030 PRINT FLP,' CONTROLLED'
```

```
2040 PRINT FLP,TAB(Z1);'TENSION.  RETAINS STYLE WELL.  IT HAS A'
2050 PRINT FLP,TAB(Z1);'TENDENCY TO BE BRITTLE AND NEEDS MORE ';
2060 PRINT FLP,' MOISTURE';
2070 PRINT FLP,'.  IT DOES VERY WELL LAYERED.'
2080 GOTO 0380
2090 PRINT FLP,TAB(Z1);'IDEAL FOR VERY LONG HAIR.  IT WILL ';
2100 PRINT FLP,'NEED A PERM-'
2110 PRINT FLP,TAB(Z1);'ANENT FOR STYLABILITY AND CURL RETENTION';
2120 PRINT FLP,'  IDEAL'
2130 PRINT FLP,TAB(Z1);'FOR HAIR COLOR TO MAKE IT LOOK LESS ';
2140 PRINT FLP,'BULKY.'
2150 GOTO 0380
2160 PRINT FLP,TAB(Z1);'MOST IDEAL OF ALL HAIR.  HAS A GOOD BODY';
2170 PRINT FLP,'.  IS '
2180 PRINT FLP,TAB(Z1);'VERY STRONG AND WILL DRY NATURALLY ';
2190 PRINT FLP,'INTO STYLES'
2200 PRINT FLP,TAB(Z1);'WITH MINIMUM LABOR.  DOES EXTREMELY ';
2210 PRINT FLP,'WELL SHORT.'
2220 GOTO 0380
2230 PRINT FLP,TAB(Z1);'VERY STRONG HAIR.  BUT USUALLY VERY ';
2240 PRINT FLP,'BRITTLE. '
2250 PRINT FLP,TAB(Z1);'REQUIRES MUCH MOISTURE AND LUBRICANT. ';
2260 PRINT FLP,' WILL NOT'
2270 PRINT FLP,TAB(Z1);'DO WELL LONG.  TENDS TO BE BUSHY ';
2280 PRINT FLP,'LOOKING. '
2290 PRINT FLP,TAB(Z1);'LAYERED CUTS ARE PREFERRED AND DRIED'
2300 PRINT FLP,TAB(Z1);' NATURALLY   HARD TO COLOR.'
2310 GOTO 0380
2320 PRINT FLP,TAB(Z1);'VERY STRONG HAIR.  TREMENDOUS CURL ';
2330 PRINT FLP,'RETENTION'
2340 PRINT FLP,TAB(Z1);'BUT IS VERY DIFFICULT TO BEND SO MAY';
2350 PRINT FLP,' REQUIRE A'
2360 PRINT FLP,TAB(Z1);'PERMANENT BECAUSE IT HAS POOR';
2370 PRINT FLP,' ELASTICITY. '
2380 PRINT FLP,TAB(Z1);'CHOOSE LARGER RODS AND WAIT ONLY FOR';
2390 PRINT FLP,' ''S'' FORMATION.'
2400 GOTO 0380
2410 PRINT FLP,TAB(Z1);'WILL HANDLE QUITE WELL.  IT''S VERY ';
2420 PRINT FLP,'STRONGAND'
2430 PRINT FLP,TAB(Z1);'WILL RETAIN STYLE FOR A LONG DURATION.';
2440 PRINT FLP,' TENDS'
2450 PRINT FLP,TAB(Z1);'TO BE BRITTLE AND WILL NEED MOISTURE';
2460 PRINT FLP,TAB(Z1)'& LUBRICATION.  HAIR IS HARD TO COLOR.'
2470 GOTO 0380
2480 PRINT FLP,TAB(Z1);'INVERTED TRIANGULAR:  WEAR TRIANGULAR '
2490 PRINT FLP,TAB(Z1);'FRAMES--WIDER BOTTOM AND NARROWER TOP.'
2500 GOTO 0450
2510 PRINT FLP,TAB(Z1);'OVAL:  NOT LIMITED.  YOU CAN WEAR ';
2520 PRINT FLP,'ALMOST ANY FRAMES.'
2530 GOTO 0450
2540 PRINT FLP,TAB(Z1);'SQUARE:  NO SQUARE OR SMALL ROUND ';
2550 PRINT FLP,'FRAMES '
2560 PRINT FLP,TAB(Z1);'WEAR BIGGISH FRAMES WITH ROUND LINES.'
2570 GOTO 0450
2580 PRINT FLP,TAB(Z1);'ROUND:  NO SMALL ROUND GLASSES.  WEAR ';
2590 PRINT FLP,'ANGULAR '
2600 PRINT FLP,TAB(Z1);'FRAMES WITH STRONG HORIZONTAL LINES.'
2610 GOTO 0450
2620 PRINT FLP,TAB(Z1);'TRIANGULAR:  WEAR FRAMES HEAVIER ON TOP';
2630 PRINT FLP,' AND'
2640 PRINT FLP,TAB(Z1);'NARROWER ON THE BOTTOM.  FLATTISH TOP, ';
2650 PRINT FLP,'SQUARE'
2660 PRINT FLP,TAB(Z1);'UPPER CORNERS AND ROUNDED BOTTOMS.'
```

```
2670 GOTO 0450
2680 PRINT FLP,TAB(Z1);'RECTANGULAR:  WEAR FRAMES THAT CURVE ON';
2690 PRINT FLP,'CORN-'
2700 PRINT FLP,TAB(Z1);'ERS TO GIVE THE ILLUSION OF ROUNDNESS.'
2710 GOTO 0450
2720 FOR X=1 TO 15
2730 PRINT
2740 NEXT X
2750 RETURN
2760 GOSUB 2720
2770 PRINT '*********************************************'
2780 PRINT '*********| ERROR, TRY AGAIN |*********'
2790 PRINT '*********************************************'
2800 PRINT
2810 RETURN
0010 REM THIS THE SEVENTH IN A SERIES OF SYMMETRY ANALYSIS
0020 REM PROGRAMS WRITTEN FOR BRODEUR INC.
0030 REM THIS PROGRAM PRINTS A LETTER TO THE STYLIST.
0040 REM DATE-WRITTEN. 04-27-78
0050 REM PROGRAMMER. WALT BRUBAKER.
0060 USE A(25),A$,B$
0070 PRINT FLP,TAB(50)'(C) 1978 JACQUES BRODEUR'
0080 FOR X=1 TO 19
0090 PRINT FLP,
0100 NEXT X
0110 X=6
0120 PRINT FLP,TAB(X)'A WORD'
0130 PRINT FLP,
0140 PRINT FLP,TAB(X)'TO THE STYLIST'
0150 PRINT FLP,
0160 PRINT FLP,
0170 PRINT FLP,TAB(X)'YOUR PATRON HAS JUST PARTICIPATED IN A ';
0180 PRINT FLP,'UNIQUE NEW PROGRAM CALLED'
0190 PRINT FLP,
0200 PRINT FLP,TAB(X)'COMPUTERIZED SYMMETRY ANALYSIS.  BASED ';
0210 PRINT FLP,'ON SCIENTIFIC PRINCIPLES'
0220 PRINT FLP,
0230 PRINT FLP,TAB(X)'RELATING TO BODY, HEAD AND FACIAL SYMME';
0240 PRINT FLP,'TRY, THE DATA HAS BEEN ANALYZED'
0250 PRINT FLP,
0260 PRINT FLP,TAB(X)'BY COMPUTER TO PROVIDE YOU WITH AN ';
0270 PRINT FLP,'OVERVIEW OF THE LENGTH, DENSITY'
0280 PRINT FLP,
0290 PRINT FLP,TAB(X)'AND OTHER FACTORS THAT GO INTO HELPING ';
0300 PRINT FLP,'YOU SELECT THE BEST'
0310 PRINT FLP,
0320 PRINT FLP,TAB(X)'HAIRSTYLE FOR YOUR PATRON. THIS ';
0330 PRINT FLP,'MATERIAL IS MEANT TO SERVE AS A'
0340 PRINT FLP,
0350 PRINT FLP,TAB(X)'GUIDE; ULTIMATELY, THE FINAL CREATIVE ';
0360 PRINT FLP,'RESPONSIBILITY FOR THE'
0370 PRINT FLP,
0380 PRINT FLP,TAB(X)'HAIRSTYLE RESTS WHERE IT ALWAYS HAS, ';
0390 PRINT FLP,'WITH YOU, THE STYLIST.'
0400 PRINT FLP,
0410 PRINT FLP,TAB(X)'BLENDING THE BEST OF OUR SCIENTIFIC ';
0420 PRINT FLP,'ANALYSIS WITH YOUR CREATIVE'
0430 PRINT FLP,
0440 PRINT FLP,TAB(X)'SKILLS, WE TRUST YOUR PATRON WILL PLACE ';
0450 PRINT FLP,'EVER GREATER TRUST IN'
0460 PRINT FLP,
0470 PRINT FLP,TAB(X)'THE PROFESSIONALS OF THE BEAUTY ';
0480 PRINT FLP,'COMMUNITY TO WORK TOGETHER FOR'
```

```
0490 PRINT FLP,
0500 PRINT FLP,TAB(X)'HIS OR HER BEST INTERESTS.'
0510 FOR X=1 TO 9
0520 PRINT FLP,
0530 NEXT X
0540 PRINT FLP,TAB(50)'(C) 1978 JACQUES BRODEUR'
0550 FOR X=1 TO 4
0560 PRINT FLP,
0570 NEXT X
0580 REM THAT'S ALL FOLKS
0590 END
```

We claim:

1. A method of analyzing an individual subject person's physical characteristics to assist in hair styling comprising:
   - measuring a plurality of values of the person's height and head dimensions.
   - inputting said measured values of physical measurements of the subject person into a digital computer and temporarily storing said values therein,
   - inputting into the digital computer predetermined values of normal ratios of the height and head dimensions for subjects of the same sex,
   - storing the values of said normal ratios in said digital computer,
   - inputting into said digital computer predetermined recommendations of distribution of hair volume as a function of deviations from said normal ratios,
   - storing said recommendations in said digital computer in a table,
   - calculating in said digital computer the ratios of the subject person corresponding to the said normal ratios for subjects of the same sex,
   - calculating in said digital computer the deviations between values of the subject person ratios and the values of the normal ratios stored in said computer,
   - comparing in said digital computer the deviations of the ratios of said subject person with the stored recommendations,
   - driving with said computer a display device which displays the recommendations for hair volume distribution corresponding to the correspondence of said recommendations with the deviations of the ratios of said subject person and said recommendations, and
   - manually preparing a chart representing said recommendations on a facial outline.

2. The method in accordance with claim 1 wherein the subject person values inputted include the subject's head length and width, and the head length to width ratio, $LW_R$ is calculated.

3. The method in accordance with claim 1 wherein the subject person values inputted include the subject's forehead and jaw width, and the subject's forehead to jaw ratio, $FJ_R$, is calculated.

4. The method in accordance with claim 1 wherein the subject person values inputted include the subject's shoulder and head width, and shoulder ratio, $S_R$, is calculated therefrom.

5. The method in accordance with claim 1 wherein the subject person values inputted include the subject's neck and head length, and neck ratio $N_R$ is calculated therefrom.

6. The method in accordance with claim 1 wherein the subject person values inputted include the subject's head depth and head height, and the horizontal ratio is calculated therefrom.

7. The method in accordance with claim 1 wherein the subject person values inputted include the subject's length of the diagonal from the chin to the parietal bone, and the face length, and the diagonal ratio $D_R$ is calculated therefrom.

8. The method in accordance with claim 1 wherein the subject person values inputted include the subject's ear protrusion.

9. The method in accordance with claim 1 wherein the subject person values inputted include the subject's eye span and eye span ratio $S_R$ is calculated therefrom.

10. The method in accordance with claim 1 wherein the subject person values inputted include length of the subject's nose from tip to start of the bridge and length of the subject's face, and nose length ratio $N_R$ is calculated therefrom.

11. The method in accordance with claim 1 further including:
   - inputting into said digital computer a plurality of values representing discrete observations of the subject person's facial characteristics;
   - storing in said digital computer a plurality of recommendations for hair volume distribution related to said discrete observations;
   - calculating in said digital computer responsive to values of said deviations and said observations, a plurality of recommendations for hair volume distributions; and
   - displaying said recommendations.

12. The method in accordance with claim 11 wherein said discrete facial characteristics inputted into said digital computer include the subject's eye symmetry.

13. The method in accordance with claim 11 wherein said discrete facial characteristics inputted include the subject's degree of nose bend and direction.

14. The method in accordance with claim 11 wherein said discrete facial characteristics inputted include the subject's ear symmetry.

15. The method in accordance with claim 11 wherein said discrete facial characteristics inputted include the subject's hair line.

16. The method in accordance with claim 11 wherein said discrete facial characteristics inputted include the subject's hair texture.

17. The method in accordance with claim 11 wherein said discrete facial characteristics inputted include the subject's hair type.

18. The method in accordance with claim 11 wherein said discrete facial characteristics inputted include whether glasses are worn.

19. The method in accordance with claim 11 wherein said discrete facial characteristics include the subject's facial shape.

* * * * *